US009199232B2

(12) United States Patent
Flavin et al.

(10) Patent No.: US 9,199,232 B2
(45) **Date of Patent: *Dec. 1, 2015**

(54) FLOW CONTROL DEVICE FOR ASSAYS

(75) Inventors: Diarmuid Flavin, Ballsbridge (IE); Shane Moynihan, Blackrock (IE); Jan Kruger, Cobh (IE); Jim Walsh, Monkstown (IE)

(73) Assignee: Biosensia Patents Limited, Dublin (IE)

( * ) Notice: Subject to any disclaimer, the term of this patent is extended or adjusted under 35 U.S.C. 154(b) by 187 days.

This patent is subject to a terminal disclaimer.

(21) Appl. No.: 13/639,430

(22) PCT Filed: Apr. 6, 2011

(86) PCT No.: PCT/IB2011/001473

§ 371 (c)(1),
(2), (4) Date: Nov. 9, 2012

(87) PCT Pub. No.: WO2011/124991

PCT Pub. Date: Oct. 13, 2011

(65) Prior Publication Data

US 2013/0129580 A1 May 23, 2013

Related U.S. Application Data

(60) Provisional application No. 61/321,707, filed on Apr. 7, 2010.

(51) Int. Cl.
*B01L 3/00* (2006.01)

(52) U.S. Cl.
CPC ..... *B01L 3/5023* (2013.01); *B01L 2200/0689* (2013.01); *B01L 2200/12* (2013.01);
(Continued)

(58) Field of Classification Search
CPC ..... B01L 3/5023; B01L 2300/0636; B01L 2400/0406; B01L 2300/0825; B01L 2200/0689; B01L 2200/12; B01L 2400/0688; B01L 2300/0887; B01L 2300/069; Y10T 29/494
See application file for complete search history.

(56) References Cited

U.S. PATENT DOCUMENTS

| | | | |
|---|---|---|---|
| 4,695,544 | A | 9/1987 | Monaghan et al. |
| 4,703,017 | A | 10/1987 | Campbell et al. |
| 4,730,017 | A | 3/1988 | Avar |
| 4,743,560 | A | 5/1988 | Campbell et al. |
| 4,956,275 | A | 9/1990 | Zuk et al. |

(Continued)

FOREIGN PATENT DOCUMENTS

| | | |
|---|---|---|
| EP | 1175940 A1 | 1/2002 |
| EP | 1 387 170 A1 | 2/2004 |

(Continued)

OTHER PUBLICATIONS

International Search Report for PCT/IE2008/000087 dated Mar. 20, 2009, 8 pages.

(Continued)

*Primary Examiner* — Lore Jarrett
(74) *Attorney, Agent, or Firm* — Choate, Hall & Stewart LLP

(57) ABSTRACT

The present disclosure relates to devices and methods for detecting the presence of a target analyte in a fluid sample using an assay. A fluidic device for flow control in an assay is disclosed comprising a water impermeable substrate (300) with a flow channel (301) located on its upper surface; a porous reagent pad (305) located within the flow channel, where the reagent pad includes a release zone that comprises a mobilizable reagent component of an assay; a porous sensor membrane (306) located within the flow channel downstream from the reagent pad, where the sensor membrane is separated from the reagent pad by a free space diffusion zone and where the sensor membrane includes a capture zone that comprises an immobilized capture component of the assay; a water impermeable top support located within the flow channel and disposed over at least a portion of the sensor membrane; and a flow control medium that forms a water impermeable seal around a portion of the top support and sensor membrane, where the seal is configure to direct flow of fluid into the sealed portion of the sensor membrane.

20 Claims, 38 Drawing Sheets

(52) U.S. Cl.
CPC .... *B01L2300/069* (2013.01); *B01L 2300/0636* (2013.01); *B01L 2300/0825* (2013.01); *B01L 2300/0887* (2013.01); *B01L 2400/0406* (2013.01); *B01L 2400/0688* (2013.01); *Y10T 29/494* (2015.01)

(56) References Cited

U.S. PATENT DOCUMENTS

| | | | | |
|---|---|---|---|---|
| 5,075,078 | A | 12/1991 | Osikowicz et al. | |
| 5,196,302 | A | 3/1993 | Kidwell | |
| 5,200,321 | A | 4/1993 | Kidwell | |
| 5,215,713 | A * | 6/1993 | Steinbiss | 422/412 |
| 5,369,007 | A | 11/1994 | Kidwell | |
| 5,399,316 | A | 3/1995 | Yamada | |
| 5,468,648 | A | 11/1995 | Chandler | |
| 5,556,789 | A * | 9/1996 | Goerlach-Graw et al. | 436/169 |
| 5,591,645 | A | 1/1997 | Rosenstein | |
| 5,602,040 | A | 2/1997 | May et al. | |
| 5,622,871 | A | 4/1997 | May et al. | |
| 5,656,503 | A | 8/1997 | May et al. | |
| 5,872,713 | A | 2/1999 | Douglas et al. | |
| 5,874,216 | A | 2/1999 | Mapes | |
| 5,885,527 | A | 3/1999 | Buechler | |
| 5,922,615 | A | 7/1999 | Nowakowski et al. | |
| 6,019,944 | A | 2/2000 | Buechler | |
| 6,143,576 | A | 11/2000 | Buechler | |
| 6,156,270 | A | 12/2000 | Buechler | |
| 6,156,271 | A | 12/2000 | May | |
| 6,187,598 | B1 | 2/2001 | May et al. | |
| 6,194,222 | B1 | 2/2001 | Buechler et al. | |
| 6,203,757 | B1 | 3/2001 | Lu et al. | |
| 6,228,660 | B1 | 5/2001 | May et al. | |
| 6,267,722 | B1 | 7/2001 | Anderson et al. | |
| 6,271,040 | B1 | 8/2001 | Buechler | |
| 6,297,020 | B1 | 10/2001 | Brock | |
| 6,297,060 | B1 | 10/2001 | Nowakowski et al. | |
| 6,319,665 | B1 | 11/2001 | Zwanziger et al. | |
| 6,319,676 | B1 | 11/2001 | Nazareth et al. | |
| 6,352,862 | B1 | 3/2002 | Davis et al. | |
| 6,368,478 | B1 | 4/2002 | Huber et al. | |
| 6,376,195 | B1 | 4/2002 | Mapes | |
| 6,399,398 | B1 | 6/2002 | Cunningham et al. | |
| 6,406,920 | B1 | 6/2002 | Davis et al. | |
| 6,440,309 | B1 | 8/2002 | Cohen | |
| 6,448,088 | B1 * | 9/2002 | Levine et al. | 436/164 |
| 6,451,619 | B1 | 9/2002 | Catt et al. | |
| 6,454,726 | B1 | 9/2002 | Catt et al. | |
| 6,485,982 | B1 | 11/2002 | Charlton | |
| 6,551,495 | B1 | 4/2003 | Porter et al. | |
| 6,585,663 | B1 | 7/2003 | Coley et al. | |
| 6,596,140 | B2 | 7/2003 | Nordman et al. | |
| 6,602,719 | B1 | 8/2003 | Carpenter | |
| 6,632,655 | B1 | 10/2003 | Mehta et al. | |
| 6,663,831 | B2 | 12/2003 | Konecke | |
| 6,669,907 | B1 | 12/2003 | Buechler | |
| RE38,430 | E | 2/2004 | Rosenstein | |
| 6,737,278 | B1 | 5/2004 | Carlsson et al. | |
| 6,767,510 | B1 | 7/2004 | Buechler | |
| 6,767,714 | B2 | 7/2004 | Nazareth et al. | |
| 6,818,455 | B2 | 11/2004 | May et al. | |
| 6,830,731 | B1 | 12/2004 | Buechler et al. | |
| 6,844,200 | B2 | 1/2005 | Brock | |
| 6,877,892 | B2 | 4/2005 | Karp | |
| 6,905,882 | B2 | 6/2005 | Buechler | |
| 6,927,064 | B1 | 8/2005 | Catt et al. | |
| 6,951,631 | B1 | 10/2005 | Catt et al. | |
| 7,045,342 | B2 | 5/2006 | Nazareth et al. | |
| 7,090,802 | B1 | 8/2006 | Wang et al. | |
| 7,097,983 | B2 | 8/2006 | Markovsky et al. | |
| 7,109,042 | B2 | 9/2006 | May et al. | |
| 7,132,078 | B2 | 11/2006 | Rawson et al. | |
| 7,138,269 | B2 | 11/2006 | Blankenstein | |
| 7,141,212 | B2 | 11/2006 | Catt et al. | |
| 7,153,651 | B1 | 12/2006 | Drewes et al. | |
| 7,153,681 | B1 | 12/2006 | Penfold et al. | |
| RE39,644 | E | 5/2007 | Alcorn et al. | |
| RE39,664 | E | 5/2007 | Gordon et al. | |
| 7,238,537 | B2 | 7/2007 | Davis et al. | |
| 7,239,394 | B2 | 7/2007 | Sharrock et al. | |
| 7,244,392 | B1 | 7/2007 | Konecke | |
| 7,315,378 | B2 | 1/2008 | Phelan et al. | |
| 7,317,532 | B2 | 1/2008 | Sharrock et al. | |
| 7,384,796 | B2 | 6/2008 | Davis et al. | |
| 7,407,813 | B2 | 8/2008 | Davis et al. | |
| 7,410,768 | B2 | 8/2008 | Butlin et al. | |
| 7,416,700 | B2 | 8/2008 | Buechler et al. | |
| 7,445,941 | B2 | 11/2008 | Buechler | |
| 7,459,314 | B2 | 12/2008 | Guo et al. | |
| 7,524,456 | B1 | 4/2009 | Buechler | |
| 7,611,669 | B1 * | 11/2009 | Crisanti et al. | 422/412 |
| 7,615,191 | B2 | 11/2009 | Buechler | |
| 7,632,460 | B2 | 12/2009 | Catt et al. | |
| 8,835,184 | B2 | 9/2014 | Redmond et al. | |
| 2002/0052049 | A1 | 5/2002 | Weigl et al. | |
| 2002/0150501 | A1 | 10/2002 | Robertson et al. | |
| 2003/0119203 | A1 | 6/2003 | Wei et al. | |
| 2004/0023412 | A1 | 2/2004 | Carlsson et al. | |
| 2004/0048322 | A1 | 3/2004 | Nakajima | |
| 2004/0077103 | A1 | 4/2004 | Buechler | |
| 2004/0081581 | A1 * | 4/2004 | Mount et al. | 422/61 |
| 2004/0106162 | A1 | 6/2004 | Glasel et al. | |
| 2004/0137640 | A1 * | 7/2004 | Hirao et al. | 436/514 |
| 2004/0142495 | A1 | 7/2004 | Hartman et al. | |
| 2004/0161859 | A1 | 8/2004 | Guo et al. | |
| 2004/0228764 | A1 | 11/2004 | Stephens et al. | |
| 2004/0241047 | A1 | 12/2004 | Buechler et al. | |
| 2005/0079634 | A1 | 4/2005 | Wilding et al. | |
| 2005/0106739 | A1 | 5/2005 | Cabuz et al. | |
| 2005/0130292 | A1 | 6/2005 | Ahn et al. | |
| 2006/0018790 | A1 * | 1/2006 | Naka et al. | 422/58 |
| 2006/0029924 | A1 | 2/2006 | Brewster et al. | |
| 2006/0040408 | A1 | 2/2006 | Jones et al. | |
| 2006/0172435 | A1 * | 8/2006 | Cho et al. | 436/514 |
| 2006/0276108 | A1 | 12/2006 | Benson | |
| 2007/0219908 | A1 | 9/2007 | Martinez | |
| 2008/0038759 | A1 | 2/2008 | Keren et al. | |
| 2009/0101559 | A1 | 4/2009 | Bala Subramaniam et al. | |
| 2009/0162833 | A1 * | 6/2009 | Mertens et al. | 435/5 |
| 2009/0196792 | A1 | 8/2009 | Raj et al. | |
| 2010/0081216 | A1 | 4/2010 | Yager et al. | |
| 2010/0151553 | A1 | 6/2010 | Bjork et al. | |
| 2012/0245038 | A1 | 9/2012 | Linton et al. | |

FOREIGN PATENT DOCUMENTS

| | | | | |
|---|---|---|---|---|
| EP | 1095270 | B1 | 3/2004 | |
| EP | 1046028 | B1 | 10/2005 | |
| EP | 1792655 | A1 | 6/2007 | |
| EP | 2049897 | A1 | 4/2009 | |
| GB | 2432420 | A | 5/2007 | |
| WO | WO-9935486 | A1 | 7/1999 | |
| WO | WO-0004381 | A1 | 1/2000 | |
| WO | WO-2004038414 | A1 | 5/2004 | |
| WO | WO-2004087322 | A2 | 10/2004 | |
| WO | WO-2006/083053 | A1 | 8/2006 | |
| WO | WO-2007019479 | A2 | 2/2007 | |
| WO | WO-2007065695 | A1 | 6/2007 | |
| WO | WO-2008018073 | A1 | 2/2008 | |
| WO | WO-2008070865 | A2 | 6/2008 | |
| WO | WO-2008128534 | A1 | 10/2008 | |
| WO | WO2009/034563 | A2 * | 3/2009 | G01N 33/543 |

OTHER PUBLICATIONS

Written Opinion for PCT/IE2008/000087 dated Mar. 14, 2010, 12 pages.
International Search Report for PCT/IB2011/001473, mailed on Oct. 18, 2011, 5 pages.
Written Opinion for PCT/IB2011/001473, mailed on Oct. 18, 2011, 6 pages.

* cited by examiner

FLOW CONTROL DEVICE FOR ASSAYS

CROSS-REFERENCE TO RELATED APPLICATIONS

This present application is a national filing under 35 U.S.C. 371 of International Application No. PCT/IB2011/001473 (PCT Publication No. WO 2011/124991), filed Apr. 6, 2011, which claims priority to U.S. provisional application No. 61/321,707, filed Apr. 7, 2010, the entirety of which is hereby incorporated herein by reference.

BACKGROUND OF THE INVENTION

The reliability of flow based assays depends in part on how well the device used to perform the assay regulates and controls the flow of fluid samples. This is particularly the case for quantitative assays. There is therefore a need in the art for devices that control the speed at which the fluid sample flows through the device and therefore minimize variability. The present disclosure relates in general to devices and methods that meet this need.

SUMMARY OF THE INVENTION

In one aspect, the present disclosure provides a fluidic device for flow control in an assay. In general, the fluidic device comprises a water impermeable substrate with a flow channel located on its upper surface; a porous reagent pad located within the flow channel, where the reagent pad includes a release zone that comprises a mobilizable reagent component of an assay; a porous sensor membrane located within the flow channel downstream from the reagent pad, where the sensor membrane is separated from the reagent pad by a free space diffusion zone and where the sensor membrane includes a capture zone that comprises an immobilized capture component of the assay; a water impermeable top support located within the flow channel and disposed over at least a portion of the sensor membrane; and a flow control medium that forms a water impermeable seal around a portion of the top support and sensor membrane, where the seal is configured to direct flow of fluid into the sealed portion of the sensor membrane.

In certain embodiments, the mobilizable reagent component of the assay is labeled and the immobilized capture component is unlabeled. In certain embodiments, the immobilized capture component binds to the mobilizable reagent component of the assay. In certain embodiments, the mobilizable reagent component of the assay binds to a target analyte in a fluid sample to form a complex and the immobilized capture component binds to the complex. In certain embodiments, the mobilizable reagent component of the assay binds to a target analyte in a fluid sample to form a complex and the immobilized capture component binds to the mobilizable reagent component but not to the complex.

In certain embodiments, the water impermeable top support is disposed over at least a portion of the reagent pad, the free space diffusion zone and at least a portion of the sensor membrane.

In certain embodiments, the fluidic device also includes a water impermeable bottom support located within the flow channel and disposed under at least a portion of the reagent pad and at least a portion of the sensor membrane. In certain embodiments, the flow control medium forms a water impermeable seal that surrounds a portion of the top support, sensor membrane and bottom support.

In certain embodiments, the flow control medium forms a water impermeable seal around a portion of the sensor membrane that interfaces with the free space diffusion zone. In certain embodiments, the flow control medium forms a water impermeable seal around a portion of the sensor membrane located downstream from the interface between the sensor membrane and the free space diffusion zone. In certain embodiments, the flow control medium forms a water impermeable seal around a portion of the sensor membrane located upstream from the capture zone.

In certain embodiments, the flow channel is defined by walls that drop down from the upper surface of the substrate and the flow control medium is contained within a chamber that is defined in the upper surface of the substrate and intersects the flow channel. The chamber and the flow channel may have the same depth.

In certain embodiments, the flow channel is defined by walls that drop down from the upper surface of the substrate and the fluidic device also includes a water impermeable bottom support located within the flow channel and disposed under at least a portion of the reagent pad and at least a portion of the sensor membrane. In certain embodiments, the flow control medium may be contained within a chamber that is defined in the upper surface of the substrate and intersects the flow channel. The chamber and the flow channel may have the same depth or the chamber may be deeper so that a portion of the flow control medium is located under the bottom support. Alternatively, in certain embodiments, the flow control medium may be contained in a substrate cavity that traverses the upper and lower surfaces of the substrate and intersects the flow channel.

In certain embodiments, the flow channel is defined by walls that rise up from the upper surface of the substrate and the flow control medium is contained within a chamber that is also defined by walls that rise from the upper surface of the substrate and intersects the flow channel. The walls of the chamber and the walls of the flow channel may have the same height.

In certain embodiments, the flow channel is defined by walls that rise up from the upper surface of the substrate and the downstream end of the flow channel is open. In some of these embodiments, the sensor membrane may extend beyond the downstream end of the flow channel.

In certain embodiments, the upstream end of the flow channel is in fluidic communication with an inlet on the lower surface of the substrate. A portion of the reagent pad may protrude into a portion of the inlet. In certain embodiments, the portion of the reagent pad that protrudes into the inlet is upstream of the release zone.

In certain embodiments, the sensor membrane includes a contact zone downstream of the capture zone that is not covered by the top support.

In certain embodiments, the downstream end of the flow channel is in fluidic communication with an exit on the lower surface of the substrate. In certain embodiments, no portion of the sensor membrane protrudes into the exit.

In certain embodiments the fluidic device also comprises a cover disposed over at least a portion of the top support. The cover may be disposed over a portion of the top support or the entirety of the top support. When the flow channel is defined by walls that drop down from the upper surface of the substrate, the cover may be in contact with the upper surface of the substrate. In certain embodiments, the cover includes a dispensing opening that is sized to fit around a protruding portion of the flow control medium. In practice, the dispensing opening may be used to dispense the flow control medium into a flow control chamber or cavity of the substrate. In certain embodiments, the cover is disposed such that the edge of the cover contacts the flow control zone. In these cases, the flow control medium can be dispensed into the flow control zone through the exposed section of the flow channel.

In certain embodiments, the sensor membrane includes a contact zone downstream of the capture zone that is not covered by the top support or the cover.

In certain embodiments, the flow control medium comprises a material that can be initially dispensed in a liquid phase and subsequently cured or dried to become a solid phase. For example, the material may be an adhesive. The adhesive may be a drying adhesive, a contact adhesive, a hot adhesive, an emulsion adhesive, a UV or light curing adhesive, or a pressure sensitive adhesive. In certain embodiments, the adhesive is a UV curing adhesive. The material may also be an encapsulant, e.g., an epoxy. Alternatively, the fluid control medium may comprise a material selected from silicone, natural resin, putty, or wax.

In certain embodiments, the sensor membrane may comprise two or more capture zones that are configured to detect different target analytes.

In certain embodiments, the sensor membrane may comprise a control zone that includes an immobilized control capture reagent where the reagent pad includes a mobilizable reagent that binds to the immobilized control capture reagent. In certain embodiments, the immobilized control capture reagent may bind to the mobilizable reagent component of the assay. The control zone may be located downstream of the capture zone(s).

In certain embodiments, more than one flow channel is located on the upper surface of the substrate and each flow channel comprises a porous reagent pad, a porous sensor membrane and a flow control medium configured and defined as in any one of the previous embodiments. Each flow channel may be configured to detect a different target analyte. In certain embodiments two or more channels may be configured to detect the same target analyte.

In certain embodiments, the flow channels on the upper surface of the substrate have the same dimensions and are each defined by walls that drop down from the upper surface of the substrate. In these embodiments, the flow control medium may be contained within a chamber that is defined in the upper surface of the substrate and intersects each of the flow channels. The chamber and the flow channels may have the same depth. As before, each flow channel may also comprise a water impermeable bottom support located within the flow channel and disposed under at least a portion of the reagent pad, the free space diffusion zone and at least a portion of the sensor membrane. When a bottom support is present, the chamber may be deeper than the flow channels so that portion of the flow control medium is located under the bottom supports. Alternatively, the flow control medium may be contained within a substrate cavity that traverses the upper and lower surfaces of the substrate and intersects each of the flow channels.

In certain embodiments, the flow channels on the upper surface of the substrate have the same dimensions and are each defined by walls that rise up from the upper surface of the substrate. In these embodiments, the flow control medium may be contained within a chamber that is also defined by walls that rise from the upper surface of the substrate and intersects each of the flow channels. The walls of the chamber and the walls of the flow channels may have the same height.

In another aspect, the present disclosure provides methods for making any one of the aforementioned fluidic devices.

In certain embodiments, the methods comprise providing a water impermeable substrate with a flow channel located on its upper surface; placing a porous reagent pad within the flow channel, where the reagent pad includes a release zone that comprises a mobilizable reagent component of an assay; placing a porous sensor membrane within the flow channel downstream from the reagent pad, where the sensor membrane is separated from the reagent pad by a free space diffusion zone and where the sensor membrane includes a capture zone that comprises an immobilized capture component of the assay; placing a water impermeable top support within the flow channel and over at least a portion of the sensor membrane; and introducing a flow control medium that forms a water impermeable seal around a portion of the top support and sensor membrane, where the seal is configured to direct flow of fluid from the free space diffusion zone into the sealed portion of the sensor membrane.

In certain embodiments, the water impermeable top support is placed over at least a portion of the reagent pad, the free space diffusion zone and at least a portion of the sensor membrane.

In certain embodiments, the steps of placing the porous reagent pad and the porous sensor membrane within the flow channel comprise placing at least a portion of the reagent pad and at least a portion of the sensor membrane on a water impermeable bottom support and then placing the water impermeable bottom support within the flow channel.

In certain embodiments, the flow control medium comprises a material that can be initially dispensed in a liquid phase and subsequently cured or dried to become a solid phase. According to these embodiments, the methods may further comprise a step of placing a cover over at least a portion of the top support, where the cover includes a dispensing opening and the step of introducing the flow control medium comprises dispensing the material through the dispensing opening and subsequently curing or drying the material. Alternatively, the cover may be disposed over at least a portion of the top support, extending to the edge of the flow control zone. According to this embodiment, the step of introducing the flow control medium comprises dispensing the material directly into flow control zone, with the medium touching the edge of the cover and sealing the flow channel, and subsequently curing or drying the material.

In certain embodiments, the flow channel is defined by walls that drop down from the upper surface of the substrate and the flow control medium is contained within a chamber that is defined in the upper surface of the substrate and intersects the flow channel. The chamber and the flow channel may have the same depth.

In certain embodiments, the flow channel is defined by walls that drop down from the upper surface of the substrate and the fluidic device also includes a water impermeable bottom support located within the flow channel and disposed under at least a portion of the reagent pad and at least a portion of the sensor membrane. In certain embodiments, the flow control medium may be contained within a chamber that is defined in the upper surface of the substrate and intersects the flow channel. The chamber and the flow channel may have the same depth or the chamber may be deeper so that a portion of the flow control medium is located under the bottom support. Alternatively, in certain embodiments, the flow control medium may be contained in a substrate cavity that traverses the upper and lower surfaces of the substrate and intersects the flow channel. In such embodiments, the step of introducing the flow control medium may comprise dispensing the material into the substrate cavity from both sides of the substrate and subsequently curing or drying the material.

In certain embodiments, the flow channel is defined by walls that rise up from the upper surface of the substrate and the flow control medium is contained within a chamber that is also defined by walls that rise from the upper surface of the substrate and intersects the flow channel. The walls of the chamber and the walls of the flow channel may have the same height.

In certain embodiments, the flow control medium comprises a material that can be initially dispensed in a liquid phase and subsequently cured or dried to become a solid phase. For example, the material may be an adhesive. The adhesive may be a drying adhesive, a contact adhesive, a hot adhesive, an emulsion adhesive, a UV or light curing adhesive, or a pressure sensitive adhesive. In certain embodiments, the adhesive is a UV curing adhesive. The material may also be an encapsulant, e.g., an epoxy. Alternatively, the fluid control medium may comprise a material selected from silicone, natural resin, putty, or wax.

In another aspect, the present disclosure provides a cartridge assembly that comprises any one of the aforementioned fluidic devices.

In certain embodiments, the fluidic device is sandwiched between front and rear portions of an enclosure, where the front portion of the enclosure includes an inspection window that allows the capture zone of the sensor membrane of the fluidic device to be inspected, a sample reservoir is located between the fluidic device and the rear portion of the enclosure, and the sample reservoir is in fluidic communication with the flow channel of the fluidic device via an inlet on the lower surface of the substrate of the fluidic device.

In certain embodiments, the cartridge assembly may also include a gasket located between the fluidic device and the rear portion of the enclosure that provides a seal for the sample reservoir.

In certain embodiments, the sensor membrane of the fluidic device may include a contact zone downstream of the capture zone that is not covered by the top support of the fluidic device. In such embodiments, an absorbent component may be located between the fluidic device and the front portion of the enclosure so that the absorbent component contacts the contact zone. The absorbent component may be an integral part of the front portion of the enclosure so that it is brought into contact with the contact zone when the cartridge is assembled.

In certain embodiments, the cartridge assembly includes a fluidic device that includes more than one flow channel. In some of these embodiments, the same absorbent component contacts the contact zone of each sensor membrane of the fluidic device.

In certain embodiments, the cartridge assembly comprises front and rear portions where the rear portion is comprised of one of the aforementioned fluidic devices (i.e., the fluidic device becomes the rear portion of the assembly instead of being sandwiched between front and rear portions of an enclosure). The front portion includes an inspection window that allows the capture zone of sensor membrane of the fluidic device to be inspected, a sample reservoir is located within the substrate of the fluidic device, and the sample reservoir is in fluidic communication with the flow channel of the fluidic device.

In certain embodiments, the sensor membrane of the fluidic device includes a contact zone downstream of the capture zone that is not covered by the top support of the fluidic device. In some of these embodiments, an absorbent component is located between the fluidic device and the front portion and the absorbent component contacts the contact zone. The absorbent component may be an integral part of the front portion that is brought into contact with the contact zone during assembly of the cartridge assembly.

As before, in certain embodiments, the cartridge assembly includes a fluidic device that includes more than one flow channel. In some of these embodiments, the same absorbent component contacts the contact zone of each sensor membrane of the fluidic device.

In another aspect, the present disclosure provides methods for making any one of the aforementioned cartridge assemblies. In certain embodiments, these methods comprise providing any one of the aforementioned fluidic devices and sandwiching the fluidic device between front and rear portions of an enclosure, where the front portion of the enclosure includes an inspection window that allows the capture zone of the sensor membrane of the fluidic device to be inspected, a sample reservoir is located between the fluidic device and the rear portion of the enclosure, and the sample reservoir is in fluidic communication with the flow channel of the fluidic device via an inlet on the lower surface of the substrate of the fluidic device.

In certain embodiments, the methods further comprise placing a gasket between the fluidic device and the rear portion of the enclosure, where the gasket provides a seal for the sample reservoir.

In certain embodiments, the cartridge assembly is made by providing a rear portion of the cartridge assembly that is comprised of any one of the aforementioned fluidic devices; and contacting it with a front portion of the cartridge assembly, where the front portion includes an inspection window that allows the capture zone of the sensor membrane of the fluidic device to be inspected, a sample reservoir is located within the substrate of the fluidic device, and the sample reservoir is in fluidic communication with the flow channel of the fluidic device.

In certain embodiments, the sensor membrane of the fluidic device includes a contact zone downstream of the capture zone that is not covered by the top support of the fluidic device. In some of these embodiments, the front portion of the enclosure or cartridge assembly includes an integral absorbent component that is brought into contact with the contact zone when the cartridge is assembled.

In any one of these embodiments, the cartridge assembly may include a fluidic device that includes more than one flow channel. In some of these embodiments, the same absorbent component contacts the contact zone of each sensor membrane of the fluidic device.

In another aspect, the present disclosure provides methods of using any one of the aforementioned fluidic devices or cartridge assemblies which comprises introducing a fluid sample into the fluidic device or cartridge assembly and determining whether a target analyte is present in the fluidic sample.

In another aspect, the present disclosure provides methods for pre-mixing the fluid sample with one or more mobilizable reagent components prior to introduction of the sample to the fluidic structure. In these cases, each reagent pad's release zone may not comprise a mobilizable reagent component of an assay. In another aspect, the present disclosure provides systems that comprise any one of the aforementioned fluidic devices or cartridge assemblies and a detection module for determining whether a target analyte is present in the fluidic sample.

DEFINITIONS

Figure 1:
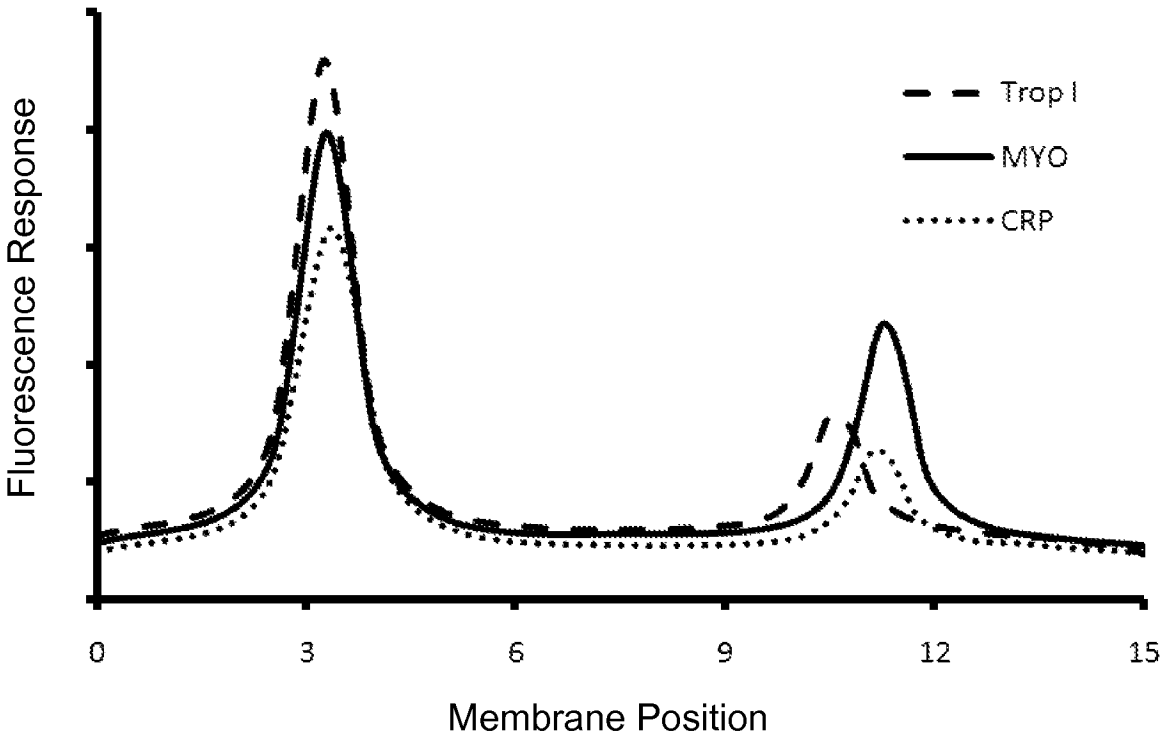
FIG. 1 shows the fluorescence response from an exemplary quantitative multi-analyte immuno-chromatographic sandwich assay for cardiac markers.

Assay—As used herein, the term "assay," refers to an in vitro analysis carried out to determine the presence or absence of one or more target analytes in a fluid sample. In certain embodiments the assay may be quantitative and determine the amount of the one or more target analytes in the fluid sample. In general, an assay includes at least one pair of reagent components where at least one of the reagent components has a high binding affinity for the other. In certain embodiments, the assay is an immunoassay (e.g., a sandwich, competitive or inhibition immunoassay). Generally, an immunoassay includes an antibody component which binds with high affinity to another antibody component or to an antigen component. In certain embodiments, the assay is a molecular assay and includes a pair of nucleic acid components which hybridize to form a complex.

Target analyte—As used herein, the term "target analyte" or "analyte" refers to the substance or substances that an assay is designed to detect. Examples of analytes include, but are not restricted to proteins (e.g., antibodies, hormones, enzymes, glycoproteins, peptides, etc.), nucleic acids (e.g., DNA, RNA, etc.), lipids, small molecules (e.g., drugs of abuse, steroids, environmental contaminants, etc.) and infectious disease agents of bacterial or viral origin (e.g., *E. coli, Streptococcus*, Chlamydia, Influenza, Hepatitis, HIV, Rubella, etc.). In the Examples we describe assays for exemplary protein target analytes (troponin I, C-reactive protein and myoglobin which are all cardiac markers) and exemplary small molecule target analytes (cocaine and methamphetamine which are drugs of abuse).

DETAILED DESCRIPTION OF CERTAIN EMBODIMENTS

The present disclosure relates to devices and methods for detecting the presence of target analytes in fluid samples using an assay. In general, the fluid samples that are analyzed according to the methods of the present disclosure can be generated in any manner from any source. In certain embodiments, a fluid sample can be isolated or generated from a physiological source, a food or beverage, or an environmental source. Physiological fluids are exemplary physiological sources and may include, without limitation, whole blood, serum, plasma, sweat, tears, urine, cerebrospinal fluid, peritoneal fluid, lymph, vaginal secretion, semen, spinal fluid, ascetic fluid, saliva, sputum, breast exudates, and combinations thereof. Examples of foods or beverages include, but are not limited to, wine, honey, soy sauce, poultry, pork, beef, fish, shellfish, and combinations thereof. Examples of environmental sources include, but are not limited to, water, environmental effluent, environmental leachates, waste water, environmental fluids that include pesticides and/or insecticides, waste by products, and combinations thereof.

In general, the devices and methods of the present disclosure comprise a porous reagent pad and a porous sensor membrane through which the fluid sample flows. These porous components are held within a water impermeable flow channel and are separated by a free space diffusion zone. Exemplary materials for these two components are described in more detail below. In certain embodiments, the devices and methods may be used to perform multiple, substantially simultaneous, assays. As discussed in more detail herein, this can be achieved by placing a plurality of flow channels on a single substrate and/or by configuring individual flow channels to perform more than one assay.

The reagent pad includes a release zone that comprises a mobilizable reagent component of the assay. In certain embodiments the release zone encompasses the entire reagent pad. The specific mobilizable reagent component that is included in the reagent pad will depend on the target analyte but also on the type of assay being performed. For example, if the assay is a sandwich assay, the release zone may include labeled antibodies that bind the target analyte to form labeled antibody-target analyte complexes. Suitable reagent components for different types of assay will be readily apparent to those skilled in the art and from the disclosure herein. For example, if the assay is a competitive or inhibition immunoassay the mobilizable reagent component may comprise an antibody specific for the target analyte or an analog of the target analyte.

As noted above, in certain embodiments the reagent component is labeled. For example, in the case of an immunoassay, the mobilizable reagent component could be a labeled antibody specific for the target analyte, a labeled analog of the target analyte (e.g., a labeled drug-protein carrier conjugate, a labeled protein antigen), etc. It will be appreciated that any label that allows the reagent to be directly or indirectly detected may be used. For example, in certain embodiments the reagent may include a fluorescent label, a luminescent label, a chemiluminescent label, colored particles such as latex, fluorescent particles such as fluorescent-dye loaded latex microspheres, an epitope label that is specifically recognized by a labeled secondary antibody, a nucleic acid label that hybridizes specifically with a fluorescent probe, etc. In certain embodiments the reagent pad may also include control reagents as disclosed herein.

Generally, the reagent component(s) in the reagent pad are mobilized by the addition of the fluid sample, and are carried through the flow channel of a fluidic device towards the sensor membrane by the flow of this fluid sample. In certain embodiments, the reagent pad may incorporate materials to aid fluid flow (e.g., increase hydrophilicity of the pad), modify the release dynamics of reagents, or otherwise assist the assay. In certain embodiments, the reagent pad may be pre-treated (e.g., with a buffer) before reagents are added.

In certain embodiments, the fluid sample may be premixed with one or more mobilizable reagent components prior to introduction of the sample to the fluidic structure. In these embodiments, the release zone of the reagent pad may not comprise a mobilizable reagent component.

The fluid sample, which may contain a target analyte and mobilized reagents, proceeds downstream through a free space diffusion zone which separates the reagent pad and sensor membrane. Without wishing to be bound by any theory, the free space diffusion zone is thought to act as a reactant well in which the interaction of target analyte and mobilized reagents is encouraged. Selection of an appropriate free space diffusion zone volume can ensure initial rapid flow through the reagent pad, aiding in the mobilization of reagents. Further, the unidirectional flow of the fluid sample though the reagent pad during reagent release can prevent possible diffusion and escape of reagent up from the reagent pad. In addition, selection of the diffusion zone volume can regulate the concentration of mobilized reagent in the fluid sample. Lateral boundaries of this zone may be defined by the impermeable walls of the flow channel. Without limitation, in a vertical assay configuration (i.e., where the flow axis is vertical), flow through the free space diffusion zone is thought to be primarily mediated by gravity.

The fluid sample passes into and permeates through a sensor membrane that includes a capture zone that comprises an immobilized capture component of the assay. For example, in the case of a sandwich immunoassay the capture component might be an unlabeled antibody that binds the labeled antibody-target analyte complex. In a competitive or inhibition assay, the capture component might be an unlabeled analog of the target analyte that binds uncomplexed labeled antibody that has been mobilized from the reagent pad. In an alternative competitive assay, the capture component might be an unlabeled antibody that binds the target analyte. Generally, different capture components (e.g., for different target analytes) are immobilised within separate capture zones of the sensor membrane. In certain embodiments, the sensor membrane may include a control zone that is separate from the capture zone(s). The control zone may be located downstream of the capture zone(s). The control zone will generally include an immobilized control capture reagent where the reagent pad includes a mobilizable reagent that binds to the immobilized control capture reagent. In certain embodiments, the immobilized control capture reagent may bind to the mobilizable reagent component of the assay. In certain embodiments the immobilized control capture reagent and the immobilized capture reagent in the capture zone may bind to different portions of the mobilizable reagent component.

In certain embodiments, the fluid sample proceeds through the sensor membrane to a defined contact zone where fluid is transferred to an adjacent absorbent component. Generally, this transfer occurs by wicking in a predominantly orthogonal direction to that of the previous liquid progression through the flow channel.

As discussed herein, the absorbent component may be designed with a bilbulosity and bed volume which ensures optimal sample transfer from the sensor membrane. For example, rapid transfer of liquid from the sensor membrane enables flow dynamics control of the assay to be defined by the specific flow properties of the selected sensor membrane. In addition, design of absorbent component bed volume to achieve transfer of sample from the sensor membrane ensures that capture zones within the sensor membrane receive a regulated sample dose, and promotes the separation and clearance of unbound labeled reagent within the sensor membrane.

Signals from captured labeled reagents may then be detected within the capture zone. Assays result in the production of a signal within the capture zone that can be read, for example, by an optical transducer, visually by eye, or suitable analytical instrument. As noted above, the detection of a capture event may rely on directly or indirectly detectable labels.

It will be appreciated that in order to obtain a reproducible assay it is advantageous to control and guide the flow of the fluid sample through the fluidic device in a reproducible fashion. As detailed herein, the flow channels comprise discrete components which achieve particular functionalities (e.g., reagent release, reagent mixing, and analyte sensing). These components incorporate a variety of media including free space zones, water impermeable flow channels and porous materials. As a result, fluid motion within, and fluid transfer between components is governed by an array of forces including capillarity, pressure, gravity and surface tension. Achieving regulated fluid transfer between these components is non-trivial. In addition, it is advantageous to prevent parasitic flow channels, and the egress of fluid sample through such alternative routes. Both of these objectives are complicated in the fluidic devices of the present disclosure by the presence of free space diffusion zones and varying flow forces. The present disclosure addresses these problems by including additional flow control zones that enable improved control and regulation of flow through the fluidic device.

The flow control zones are realised by encapsulating defined areas of the fluidic device with a flow control medium. Generally, this flow control medium extends about at least a portion of the sensor membrane. For example, in certain embodiments, the flow control zone may act as a lower seal to the free space diffusion zone. More generally, one or more flow control zones may form a seal at any portion of the sensor membrane downstream from the free space diffusion zone and upstream from the first capture zone. The flow control zones direct incoming fluid sample upstream from the flow control zone into the sensor membrane and thereby reduce the formation of unintended flow channels through which fluid sample and assay reagents might otherwise travel. In order to ensure that fluid flow proceeds entirely through the sensor membrane, the intrinsic membrane flow rates may be used to tune the steady-state flow rates of the flow channels, and the speed of the assay itself. In this regard, the use of flow control zones can aid in the regulation of flow speeds within the fluidic device as a whole. Likewise, by ensuring full fluid sample application to the sensor membranes, immobilised capture components receive a regulated dose of target analyte and assay reagents, and the separation and clearance of unbound labeled reagent is enabled.

The present disclosure also describes the use of an original top support. This top support is water impermeable and may be optically transparent. The top support is disposed upon and acts to sheathe some portion of the sensor membrane surface, and optionally some portion of the reagent pad surface. The top support may serve a number of functions. In certain embodiments, it prevents ingress of a liquid flow control medium into the porous materials. In certain embodiments it also provides a protective layer over the delicate assay materials, protecting them from physical or environmental damage. It may also define specific areas of fluid ingress and egress from the sensor membrane and reagent pad. In certain embodiments, the top support extends between the sensor membrane and reagent pad. In practice, the top support may act to define the dimensions of the free space diffusion zone, or channel flow within the free space diffusion zone. In certain embodiments, the top support is disposed over a portion of the sensor membrane. Generally, the area of the sensor membrane upstream of the top support resides within the free space diffusion zone. This is exposed to fluid within the free space diffusion zone, and acts as a fluid ingress area into the sensor membrane. Choice of top support dimensions and placement define the size of this fluid ingress area, thus acting to regulate or optimise fluid entry into the sensor membrane. In particular, larger ingress areas may enhance fluid entry into the sensor membrane, and thus, ensure that intrinsic membrane flow rates may be used to tune the steady-state flow rates of the flow channels. In certain embodiments, the top support may serve to encourage continued and directed flow through the respective assay components.

The present disclosure also describes the use of bottom supports. When included, these bottom supports may be composed of impermeable polymeric strips, with full or partial adhesive coatings. These bottom supports may be used to maintain the sensor membrane and reagent pad in a non-contiguous, defined set of positions. Further, in maintaining the relative positions of the sensor membrane and reagent pad, they can serve to define the dimensions and volumes of free space diffusion zones. In addition, these bottom supports can provide structural stability to delicate components of the device, and protect them from physical or environmental damage. Finally, they can provide a defining wall structure to free space diffusion zones.

The present disclosure also describes the assembly of fluidic devices into cartridge assemblies. These cartridge assemblies define the dimensions of the overall assay device and comprise the totality of assay components. The cartridge can act to maintain assays in a vertical or tilted orientation. Generally, the absorbent component is integral to a cartridge assembly component other than the fluidic device, and the construction of the assembly brings the absorbent material into contact with the contact zone of the sensor membrane. The fluid sample is also initially applied into a defined cartridge inlet which guides the fluid into a sample reservoir. The reservoir forms a well, holding the entirety of the fluid sample at the inlets of the flow channels of the fluidic device. The structure of the reservoir may include gaskets to prevent leakages of fluid. Overflow areas may be provided to hold excess liquid beyond a defined amount. Further, structures may be located within the sample reservoir to meter liquid doses to individual flow channels. In addition, the sample reservoir may be designed so as to limit possible fluid escape should the assay itself be tilted or tipped during operation. In certain embodiments, the reagent pad may extend into at least a portion of the inlets of the flow channels of the fluidic device. This affords an extended contact area between the reagent pad and liquid residing in the sample reservoir. In certain embodiments, the upstream wall of the flow channel may include a vent which enables release of trapped air from the reagent pad and thereby aids uniform sample flow into the reagent pad. As a result, liquid rapidly and consistently enters the reagent pad. Further, flow into the reagent pad may be encouraged by liquid pressure from fluid residing in the sample reservoir. Generally, some portion of the reagent pad resides in the flow channel of the fluidic device which is defined by water impermeable walls. In certain embodiments, the flow channel has a depth and width of dimensions similar to those of the reagent pad, plus any bottom support or top support. This encourages unidirectional flow through the encapsulated section of the reagent pad.

Immunoassay Formats

In various embodiments, the devices and methods of the present disclosure rely on a qualitative, quantitative or semi quantitative immunoassay which may be of a sandwich, competitive or displacement type. The components of each of these different immunoassay types are discussed in more detail below.

In a sandwich assay the release zone of the reagent pad comprises labeled conjugates that form a primary binding complex with target analyte in the fluid sample. For example, when the target analyte is a protein, the reagent pad may include a labeled antibody that is specific for the target protein. Conversely, when the target analyte is an antibody, the reagent pad might include a labeled version of an antigen that the target antibody recognizes (or a labeled antibody that binds the target antibody). The capture zone of the sensor membrane comprises an immobilized and unlabeled reagent that forms a secondary binding complex with the primary complex. For example, when the target analyte is a protein, the sensor membrane may include a capture antibody that binds the protein portion of the primary complex. Since the primary complex only forms in the presence of the target protein a signal is only detected from the sensor membrane when target protein is present in the fluid sample. It will be appreciated that capture reagents for different target analytes may be immobilized within different capture zones to allow for detection of multiple analytes in a single flow channel. Sensor membranes may also comprise control capture components within a control zone downstream of the capture zone(s). These may be realised, for example, using immobilised control capture reagents with affinities towards specific labeled control reagents, which are released from the reagent pad by the passage of fluid sample. Alternatively, the control capture reagent may bind to the mobilizable reagent component of the assay In a competitive or inhibition assay the release zone of the reagent pad comprises a labeled antibody specific for the target analyte or a labeled analog of the target analyte. The sensor membrane capture zone then comprises an immobilized unlabeled capture component with specific binding affinity for the target analyte or for uncomplexed labeled antibody. For example, in one embodiment the release zone of the reagent pad comprises a labeled antibody specific for the target analyte and the sensor membrane capture zone comprises an unlabeled analog of the target analyte which binds uncomplexed labeled antibody that has been mobilized from the reagent pad. It is to be understood that, in this context, an "analog" of a target analyte encompasses the target analyte itself and structural analogs of the target analyte that can compete with the target analyte for binding to the uncomplexed labeled antibody. For example, if the uncomplexed labeled antibody recognizes a specific epitope of the target analyte it may be sufficient that the analog include that epitope. It is also to be understood that an analog may include conjugated components, e.g., a protein carrier such as bovine serum albumin (BSA) that facilitates immobilization of the analog in the sensor membrane. According to this embodiment when target analyte is present in the fluid sample and reaches the reagent pad it binds to the labeled antibodies to form a complex. These complexes and uncomplexed labeled antibodies are mobilized by the fluid sample and flow downstream traversing the free space diffusion zone into and through the sensor membrane. At the capture zone only the uncomplexed labeled antibody is captured by the immobilized analog of the target analyte. The complexes formed by target analyte are not captured. Since the complexes only form in the presence of the target analyte the amount of uncomplexed labeled antibody in the capture zone is inversely related to the amount of target analyte in the fluid sample.

In an alternative embodiment of the competitive assay format, the release zone of the reagent pad comprises a labeled analog of the target analyte and the sensor membrane capture zone comprises unlabeled capture antibodies with specific binding affinity for the target analyte. It is to be understood that, in this context, an "analog" of a target analyte encompasses the target analyte itself and structural analogs of the target analyte that can compete with the target analyte for binding to the capture antibody. For example, if the capture antibody recognizes a specific epitope of the target analyte it may be sufficient that the analog include that epitope. The capture antibodies bind the target analyte and the labeled analog of the target analyte that was mobilized from the reagent pad. Because of competition between the labeled analog and the target analyte for binding in the capture zone the amount of labeled analog bound in the capture zone is inversely proportional to the amount of target analyte in the fluid sample.

Fluidic Devices

Figure 3A:
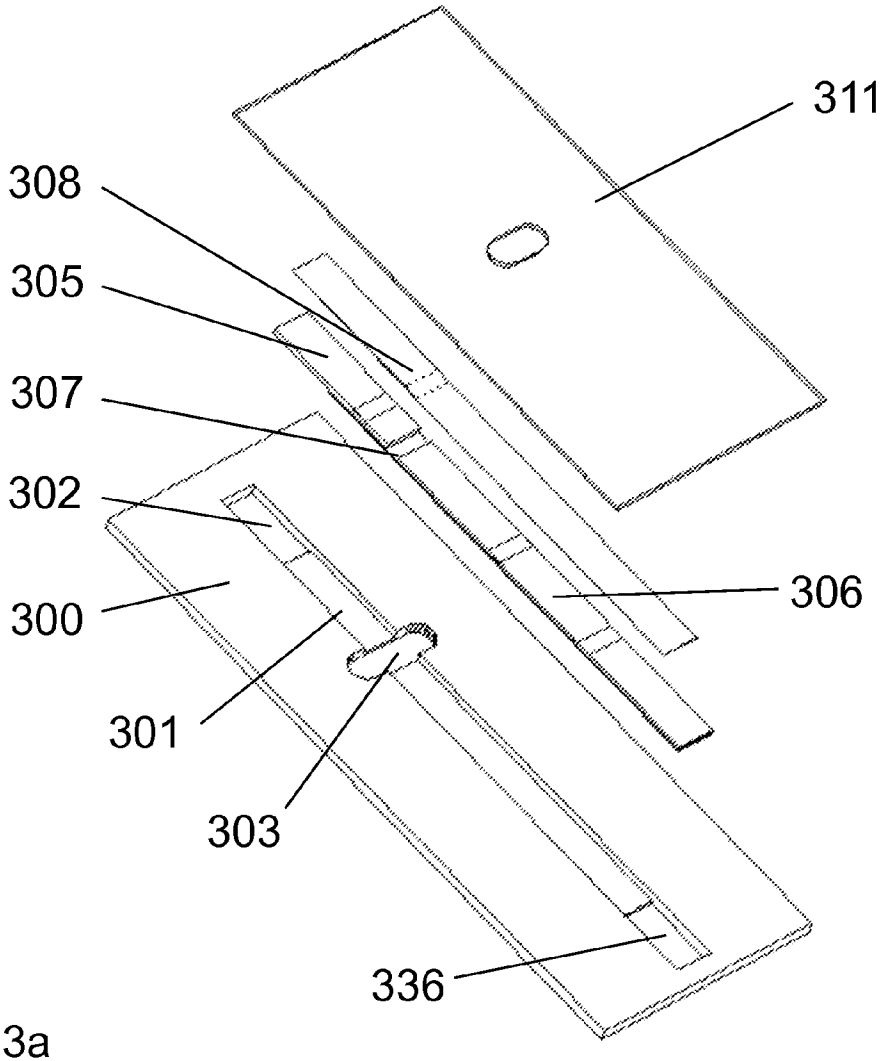
FIGS. 3*a*-3*d* show different views of an exemplary fluidic device.
Figure 3B:
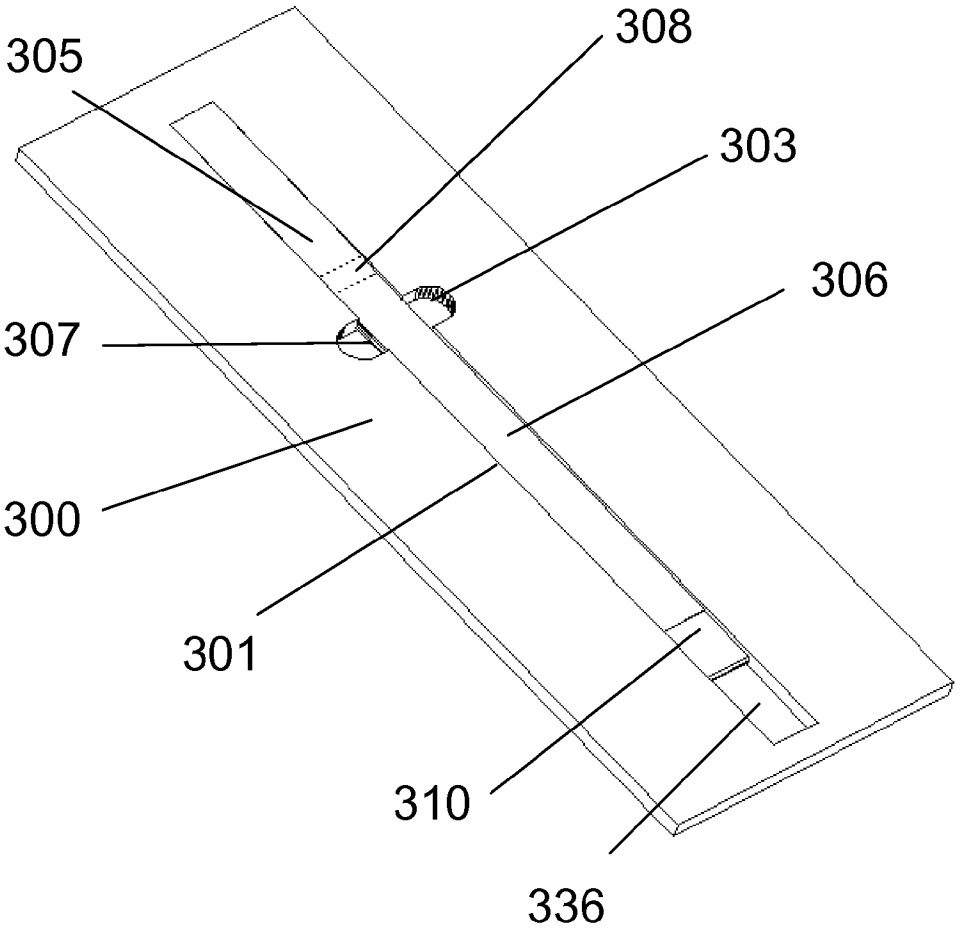
Figure 3C:
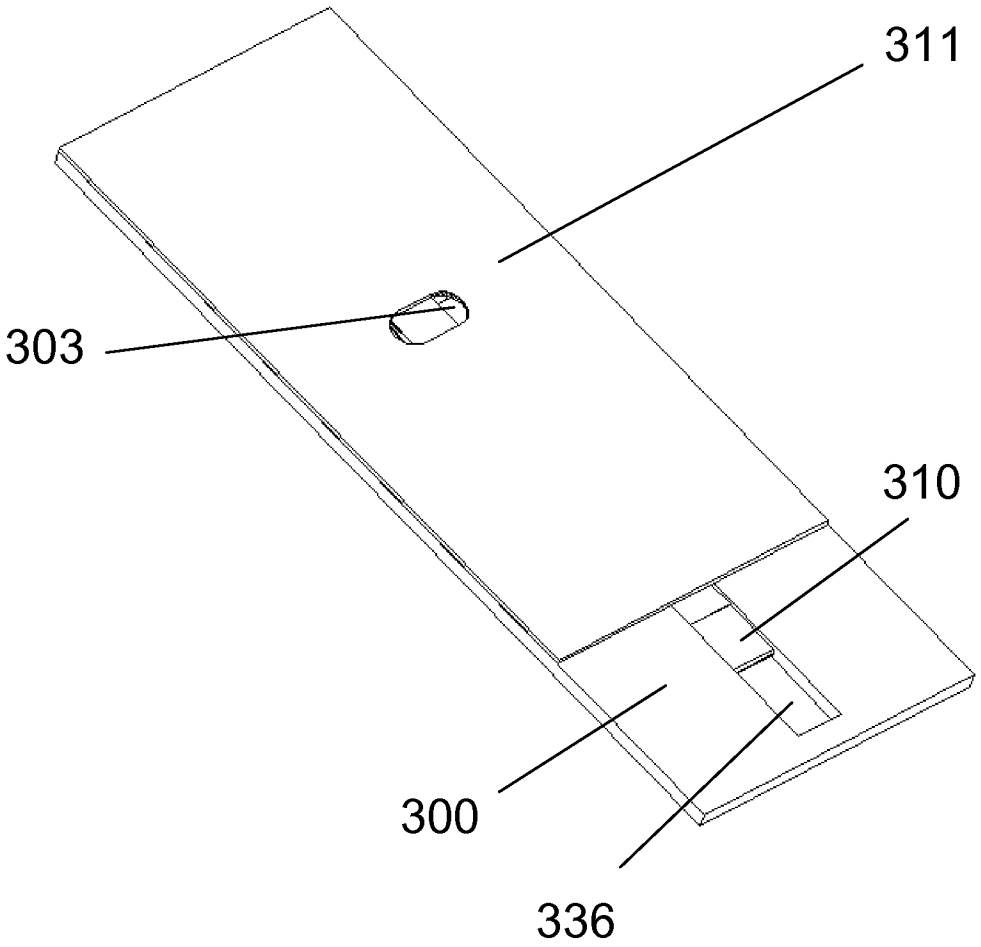
Figure 3D:
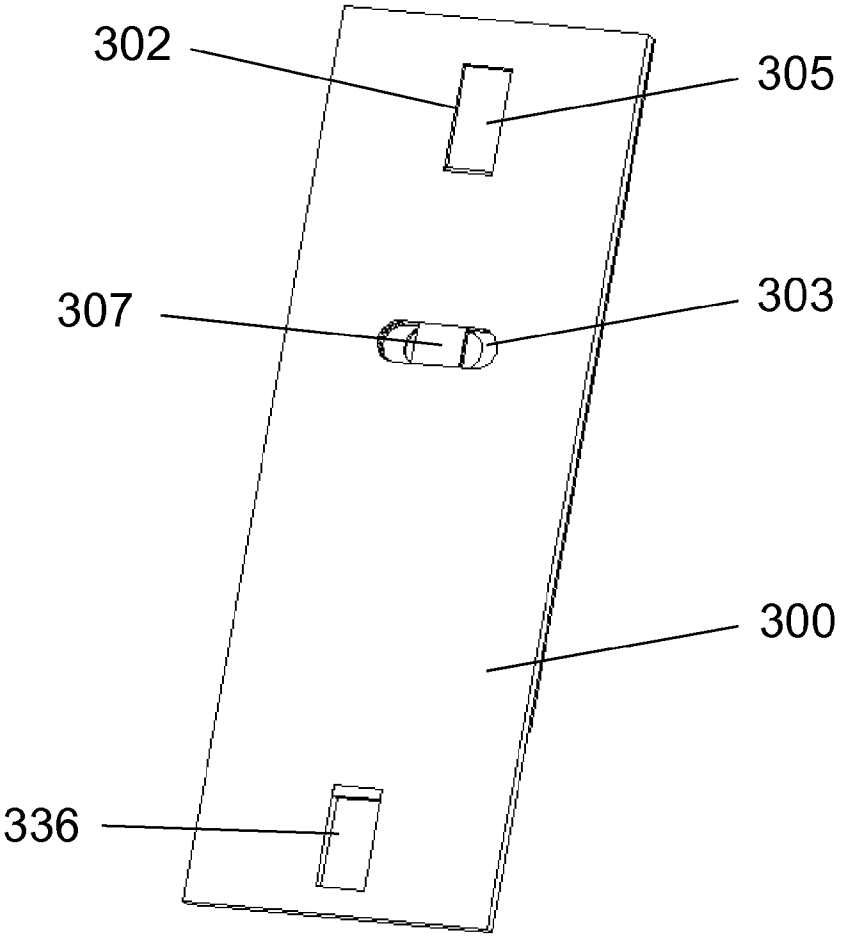

In one aspect, the present disclosure provides fluidic devices. FIGS. 3*a*-3*d* show one embodiment of a fluidic device of the present disclosure. As shown in FIG. 3*a*, the fluidic device comprises a substrate (300) with a flow channel (301) on its upper surface. A reagent pad (305) is located within the flow channel, upstream of a sensor membrane (306). The reagent pad (305) and the sensor membrane (306) are assembled on a bottom support (307) and spatially separated by a free space diffusion zone free space diffusion zone 409 is shown, for example, in FIGS. 4*a*-4*b* and 4*d*-4*e*, which illustrate certain components of an exemplary fluidic device in more detail). Part of the reagent pad (305) extends beyond the upstream end of the bottom support (307) so that the underside of the extending part is exposed to the flow channel inlet (302). The flow channel inlet (302) is in the form of an opening in the lower surface of the substrate (300). A top support (308) is disposed on the top surface of the reagent pad (305) and part of the sensor membrane (306). The exposed downstream end of the sensor membrane (306) comprises a contact zone (310) where the sensor membrane can be contacted for controlled fluid removal. As shown in FIG. 3*b*, the bottom support (307), with reagent pad (305), sensor membrane (306) and top support (308) sits confined within the flow channel (301). As shown in FIG. 3*c*, a cover (311) seals the reagent pad (305) and part of the sensor membrane (306) within the flow channel (301). The contact zone (310) of the sensor membrane (306) remains exposed. A flow control zone (303) which is shown in FIGS. 3*a*-3*b* as a cavity through the substrate (300) extends around a portion of the sensor membrane (306). As shown in subsequent figures, the flow control zone (303) can be filled with a flow control medium exemplary flow control medium 504 as shown, for example in FIGS. 5*a*-5*h*, which show various embodiments of a fluidic device of the present disclosure) that forms a water impermeable seal around a portion of the top support (308) and sensor membrane (306). The seal is configured to direct the flow of fluid into the sealed portion of the sensor membrane (306).

In general, the substrate (300) and cover (311) can be made of any material. In certain embodiments, both components are fabricated with micro- to millimeter dimensions in materials such as polymers and plastics, e.g., cyclic olefin copolymers (COC), polyethylene terephthalates (PET), polyvinyl chloride (PVC), polystyrene (PS), polyimide, polycarbonates, acrylonitrile butadiene styrene (ABS), polyethylene (PE), ethylene vinyl acetate (EVA), polypropylene (PP), etc. using, for example, injection molding, screen printing, hot embossing, laser cutting, lamination or die cutting. These components may also be fabricated in silicon or other materials using microfabrication techniques such as photolithography and etching. In certain embodiments, the cover (311) may be made of materials with good optical transparency in the visible spectrum.

In certain embodiments, the flow channel (301) has a length of about 25 mm to about 75 mm, a width of about 1.3 mm to about 5 mm, a height of about 0.05 mm to about 1 mm, and a cross-sectional area in the range of about 0.3 $mm^2$ to about 5 $mm^2$. In some embodiments, the cross-sectional area is in the range of about 1 $mm^2$ to about 2 $mm^2$. In certain embodiments, the flow channel inlet (302) has a length of about 1 mm to about 10 mm, a width of about 1.3 mm to about 5 mm. In certain embodiments the flow channel inlet (302) has substantially the same width as the flow channel (301). As shown in FIGS. 3*a*-3*d*, the flow channel (301) comprises a downstream channel exit (336). The channel exit (336) in FIGS. 3*a*-3*d* is in the form of an opening in the lower surface of the substrate (300). However, in other embodiments, the channel exit (336) may be in the form of an opening in the cover (311) located over the downstream end of the flow channel (301). In other embodiments, the channel exit (336) may be a downstream section of the flow channel (301) which is not covered by the cover (311). In certain embodiments, the channel exit (336) is about 3 mm to about 10 mm in length and about 1.3 mm to about 35 mm in width. In certain embodiments the channel exit (336) has substantially the same width as the flow channel (301).

In some embodiments, the flow channel (301) has a length of about 40 mm, a width of about 2.5 mm or about 4 mm, and a depth of about 0.6 mm. In some such embodiments, the upstream channel inlet (302) is in the form of an opening in the lower surface of the substrate (300) which has a length of about 5 mm and a width of about 2.5 mm or about 4 mm. In some such embodiments, the downstream channel exit (336) is also in the form of an opening in the lower surface of the substrate (300) which has a length of about 7 mm and a width of about 2.5 mm or about 4 mm. In one embodiment, the flow channel (301), the upstream channel inlet (302) and the downstream channel exit (336) all have substantially the same width.

Figure 4A:
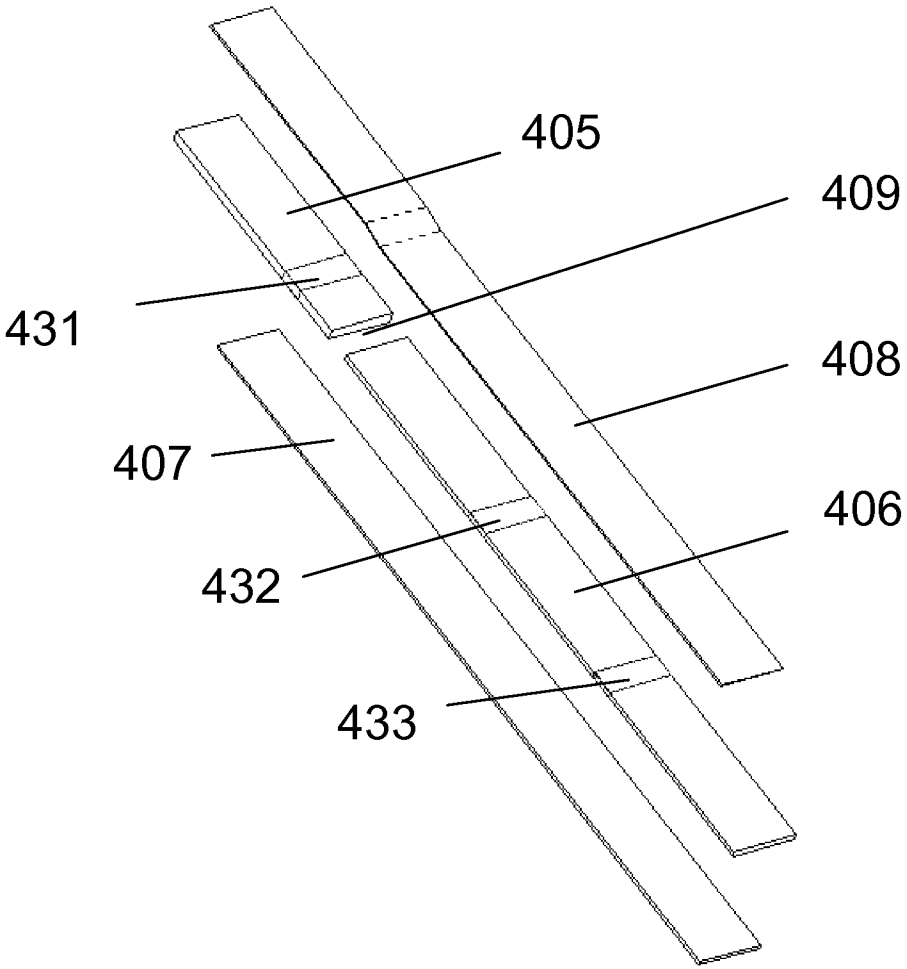
FIGS. 4*a*-4*f* show certain components of an exemplary fluidic device.
Figure 4B:
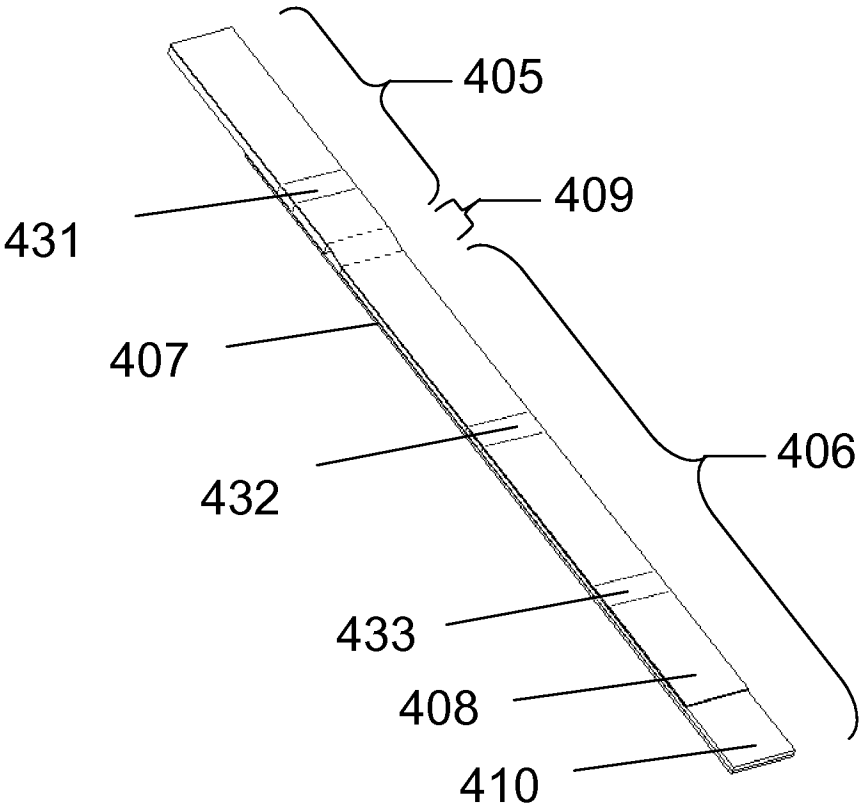
Figure 4C:
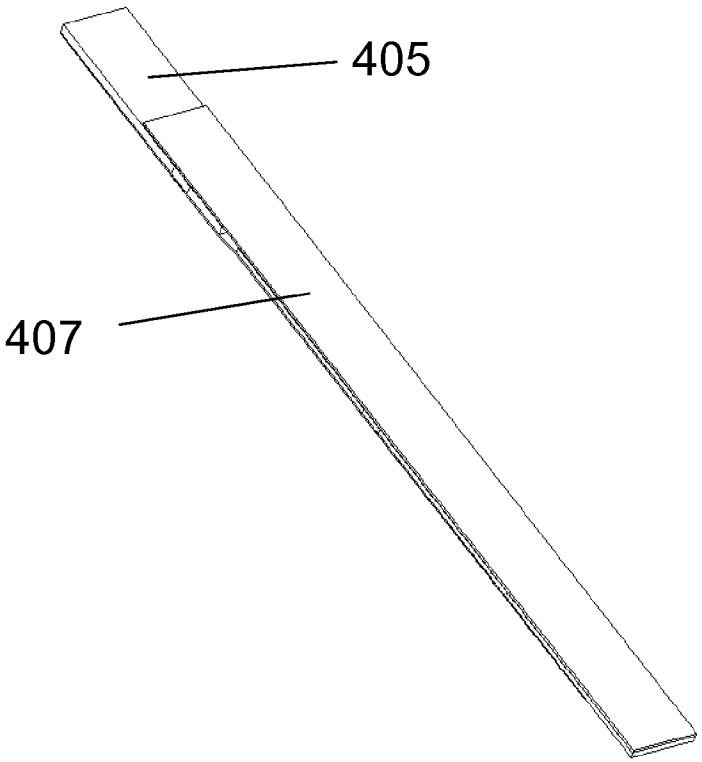
Figure 4D:
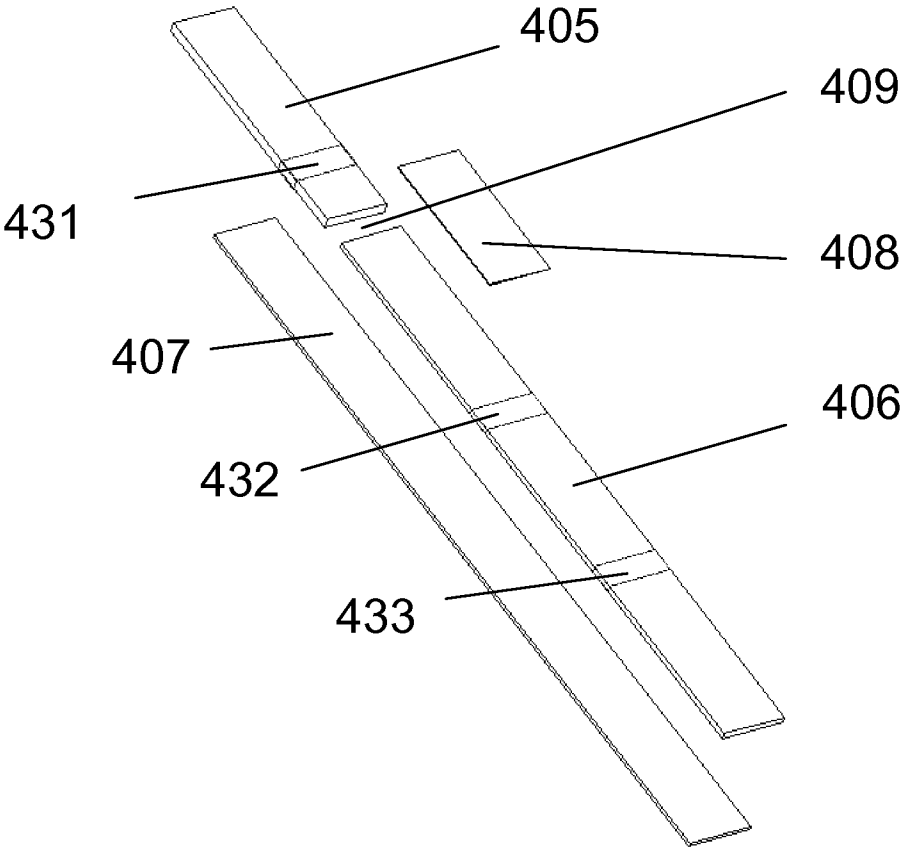
Figure 4E:
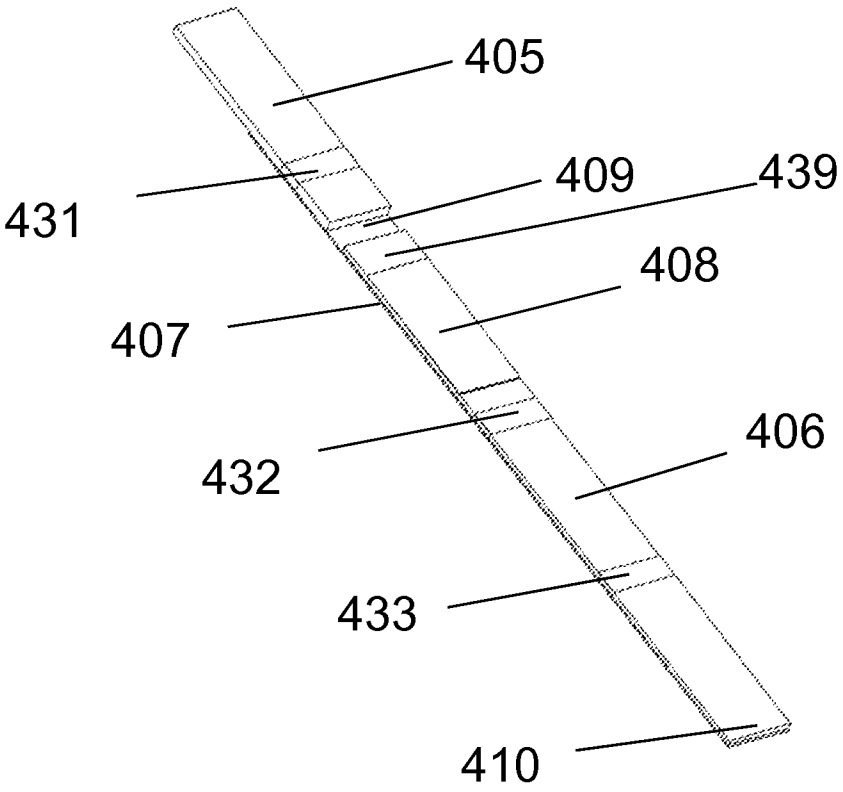
Figure 4F:
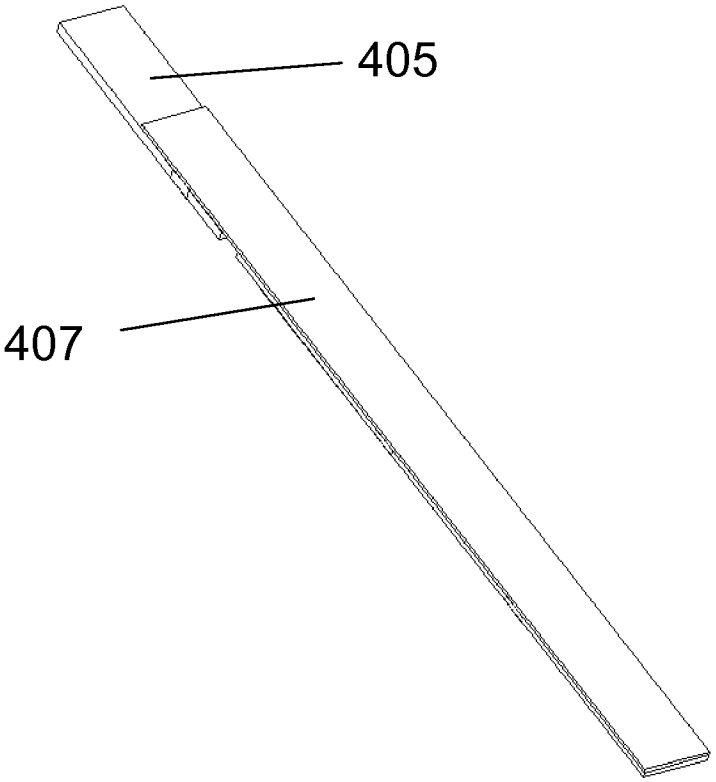

FIGS. 4*a*-4*f* illustrate certain components of an exemplary fluidic device in more detail. As shown in FIGS. 4*a* and 4*d*, in certain embodiments, the reagent pad (405) and the sensor membrane (406) are assembled onto a bottom support (407). The reagent pad (405) and the sensor membrane (406) are spatially separated by a free space diffusion zone (409). Without wishing to be bound to any theory, it is thought that the free space diffusion zone (409) may promote the mixing of reagents that have been mobilized from the reagent pad (405) with analytes in the fluid sample. In certain embodiments, the length of the free space diffusion zone (409) is in the range of about 0.5 mm to about 5 mm, e.g., about 0.5 mm to about 2 mm or about 0.5 mm to about 1 mm. As shown in FIGS. 4*a*-4*b*, the bottom support (407) with reagent pad (405) and sensor membrane (406) is covered with a top support (408) which acts as a fluid impermeable shield. The top support may also act to define the dimensions of the free space diffusion zone, or channel flow within the free space diffusion zone. The downstream end of the sensor membrane (406) comprises an exposed contact zone (410) where the membrane (406) can be contacted for controlled fluid removal. As shown in FIGS. 4*d* and 4*e*, in certain embodiments, the top support (408) only covers a portion of the sensor membrane (406). In these embodiments, the top support (408) acts as a fluid impermeable shield, with an uncovered area defining the area of fluid ingress into the sensor membrane (406) at the free space diffusion zone (409). The downstream portion of sensor membrane (406) may be exposed, and further comprises an exposed contact zone (410) where the membrane (406) can be contacted for controlled fluid removal. As shown in FIG. 4*e*, in some embodiments, a portion (439) of the sensor membrane (406) is disposed upstream of the top support (408), within the free space diffusion zone (409).

It is to be understood that the reagent pad (405), sensor membrane (406), bottom support (407) and top support (408) may be made of materials typically found in in vitro diagnostic devices. In general, the reagent pad (405) and sensor membrane (406) are porous to allow for flow of fluid samples therethrough. In contrast, the bottom support (407) and top support (408) are water impermeable and thereby provide barriers that promote flow of fluid samples through the porous reagent pad (405) and sensor membrane (406).

In general, the reagent pad (405) includes a release zone (431) that comprises one or more mobilizable reagent components of assays (e.g., a labeled anti-analyte antibody). In certain embodiments, the release zone (431) also comprises a mobilizable control reagent. The release zone may be impregnated with reagents by any method, e.g., by spray coating, jet printing, impregnation with subsequent drying, etc. It is to be understood that the release zone (431) may encompass the entire reagent pad (405) and need not be limited to a defined region of the reagent pad (405). When the release zone (431) is limited to a defined region of the reagent pad (405), it is preferably positioned downstream of the exposed part of the reagent pad (405) as shown in FIG. 4*b*.

In certain embodiments, the reagent pad (405) may be made of woven or non-woven fiber material, such as glass microfiber, polyester, polyvinyl glass fibre, nylon, reticulated foam of polyester, polyester polyurethane, polyether polyurethane, etc. In certain embodiments, the reagent pad (405) is about 5 mm to about 25 mm in length and has substantially the same width as the bottom support (407). As shown in FIGS. 4*a*-4*f*, in certain embodiments, the reagent pad (405) is assembled onto the bottom support (407) in such as way that part of the reagent pad (405) extends beyond the upstream end of the bottom support (407) and the underside of the extending part is exposed. In certain embodiments, the length of the exposed part of the reagent pad (405) is in the range of about 1 mm to about 10 mm.

In general, the sensor pad (406) includes one or more capture zones (432) each comprising an immobilized capture component of the assay (e.g., an anti-analyte antibody). In certain embodiments, the sensor pad (406) also includes a control zone (433) that comprises an immobilized control capture reagent (e.g., an antibody that binds the mobilizable control reagent in the reagent pad). As shown in FIG. 4*b*, the capture zone (432) and control zone (433) are located in different segments of the sensor membrane with the control zone (433) preferably downstream from the capture zone (432). As a result, fluid flow dynamics within the capture and control zones of the sensor membrane are similar. In particular, in the configurations shown in FIGS. 4*b* and 4*e*, any fluid sample that passes through the control zone (433) must have previously passed through the capture zone (432). In certain embodiments, the capture zone (432) and control zone (433) are sufficiently separated to reduce cross talk of reagents and/or signals between both zones. In certain embodiments, the capture zone (432) is located at a distance of between about 3 mm to about 15 mm from the upstream end of the sensor membrane (406). In certain embodiments, the distance between the capture zone (432) and the control zone (433) is about 3 mm to about 15 mm. The capture reagents can be immobilized in the capture zone (432) and control zone (433) by any known method, e.g., by spray coating, jet printing or impregnation with subsequent drying, etc. Generally, the capture component of the assay may be immobilized within the sensor membrane as a result of the microporous nature of the sensor membrane (as contrasted with the macroporous nature of the reagent pad). As discussed above, in order to facilitate immobilization, it may be advantageous to include a protein carrier when the capture component is an analog of a small molecule target analyte. This is typically not necessary when the capture component is an antibody or an analog of a protein target analyte.

In certain embodiments, the sensor membrane (406) may be made of cellulose nitrate, cellulose acetate, glass fibre, nylon, acrylic copolymer/nylon, etc. In one embodiment, the sensor membrane (406) may comprise a water impermeable backing layer, with a thickness in the range of about 0.05 mm to about 0.5 mm. In certain embodiments, the sensor membrane (406) is about 15 mm to about 45 mm in length and has substantially the same width as the bottom support (407).

In certain embodiments, the bottom support (407) may be made of a backing card material, such as cyclic olefin polymers (COP), cyclic olefin copolymers (COC), polyethylene terephthalates (PET), poly methylene methacrylate (PMMA), etc. In certain embodiments, the bottom support (407) comprises an adhesive top coating upon which the reagent pad (405) and sensor membrane (406) are adhered. The bottom support (407) may also comprise an adhesive underside coating so that it can be fixed in place within the flow channel of a fluidic device. In certain embodiments, the dimensions of the bottom support (407) are in the range of about 25 mm to about 75 mm in length, about 1.3 mm to about 5 mm in width, and about 0.05 mm to about 1 mm in thickness. In certain embodiments, the bottom support (407) has substantially the same width as the flow channel of a fluidic device. In certain embodiments, the reagent pad (405), the sensor membrane (406) and the bottom support (407) all have substantially the same width.

In certain embodiments, the top support (408) may be optically transparent or may include one or more optically transparent windows that allow for inspection of the capture zone (432) and control zone (433) of the sensor membrane. In certain embodiments, the top support may be made from one of the following materials: cyclic olefin polymers (COP), cyclic olefin copolymers (COC), polyethylene terephthalates (PET), poly methylene methacrylate (PMMA), etc. In certain embodiments, the top support (408) is a laminate material. In certain embodiments, the top support (408) comprises an adhesive underside coating. In certain embodiments, the top support (408) is about 25 mm to about 75 mm in length, about 1.3 mm to about 5 mm in width and about 0.03 mm to about 0.25 mm in thickness. In certain embodiments, the top support (408) has substantially the same width as the bottom support (407). As shown in FIGS. 4*d* and 4*e*, in certain embodiments, the tops support has a length of about 3 to 20 mm, and is placed on the sensor membrane such that the sensor membrane extends about 1 to 5 mm beyond the upstream end of the top support. In one preferred embodiment, the top support has a length of about 6 mm and is placed on the sensor membrane such that the sensor membrane extends 2 mm beyond the upstream end of the top support. As shown in FIGS. 4*b* and 4*d*, in certain embodiments, a downstream contact zone (410) of the sensor membrane is not covered by the top support (408). In certain embodiments, the contact zone (410) is about 1 mm to about 10 mm in length and has substantially the same width as the remainder of the sensor membrane (406). In certain embodiments, the contact zone (410) is narrower than the remainder of the sensor membrane (406).

In some embodiments, the assembly of FIGS. 4*a*-4*f* is configured as follows. The bottom support (407) comprises an adhesive bottom coating that adheres to the flow channel of a fluidic device and an adhesive top coating that adheres to the bottom surfaces of the reagent pad (405) and the sensor membrane (406). The bottom support (407) has a length of about 30 mm, a width of about 2.5 mm or about 4 mm and a height of about 0.15 mm. The bottom support (407) is sized to correspond substantially to the width of the flow channel of a fluidic device. The reagent pad (405) is about 10 mm in length and has substantially the same width as the bottom support (407). The reagent pad (405) is placed on the bottom support (407) such that a part of the reagent pad (405) extends beyond the upstream end of the bottom support (407) and the underside of the extending part is exposed. The exposed part of the reagent pad is about 5 mm in length. The reagent pad (405) and sensor membrane (406) are separated by a free space diffusion zone (409) which has a length of about 0.5 mm to about 1 mm. The sensor membrane (406) has dimensions of about 25 mm in length, and a width substantially similar to the width of the bottom support (407). The sensor membrane (406) comprises a water impermeable backing layer, with a thickness of about 0.25 mm.

Figure 5A:
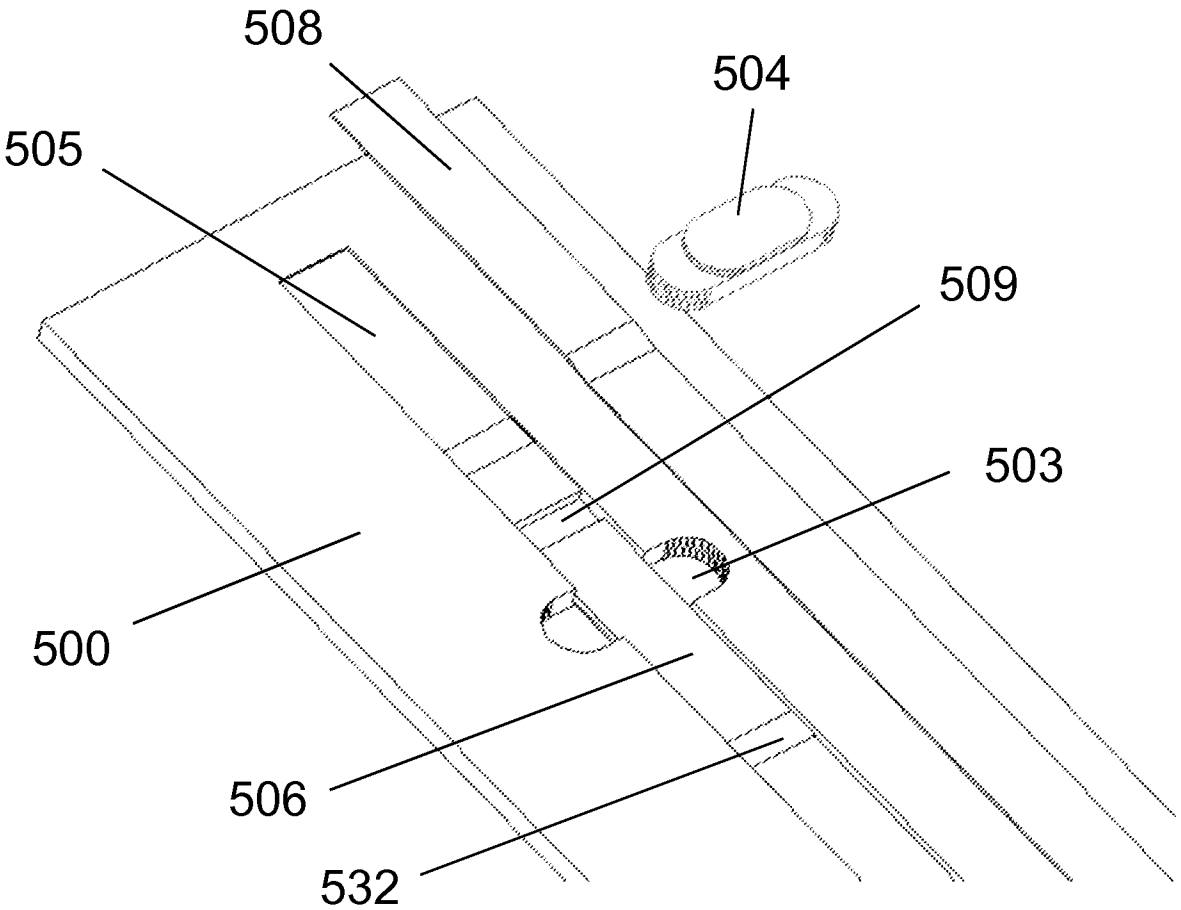
FIGS. 5*a*-5*h* show different views of several exemplary fluidic devices.
Figure 5B:
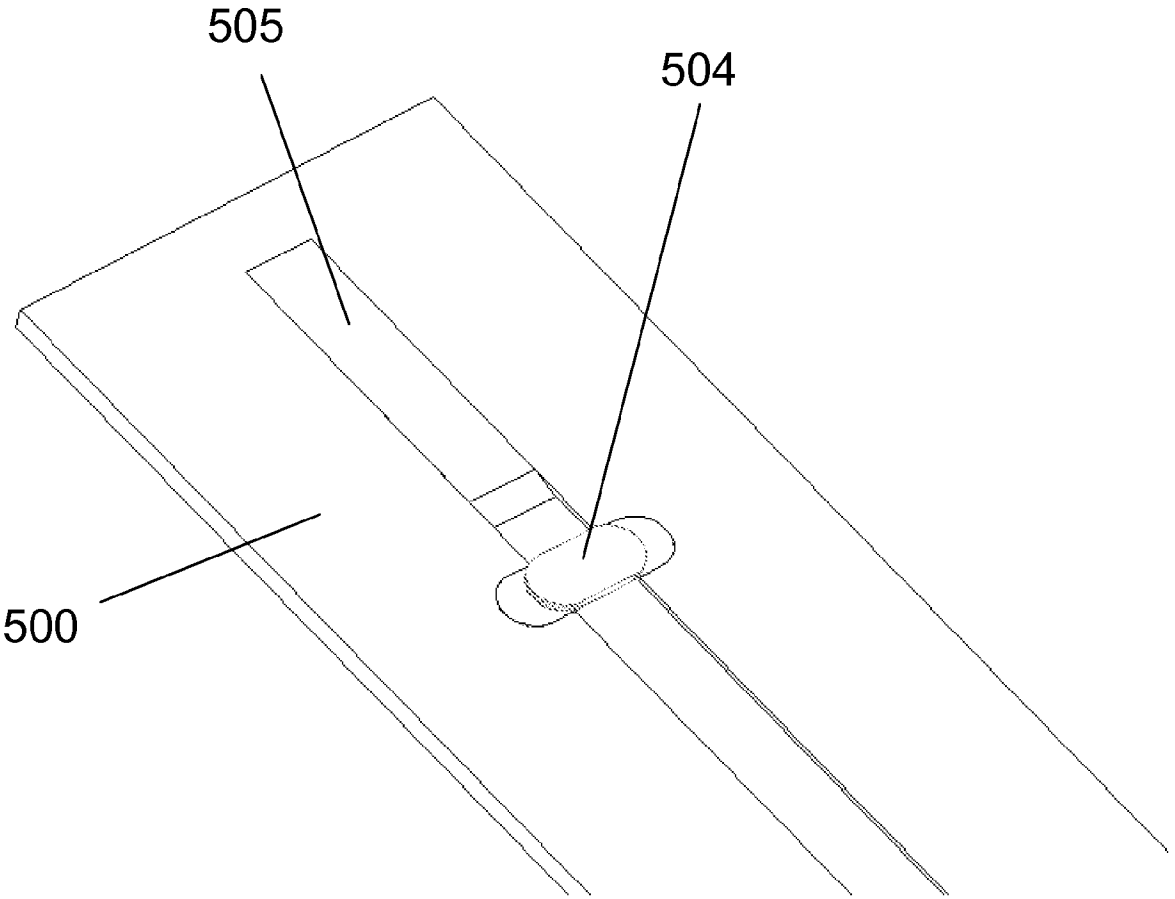
Figure 5C:
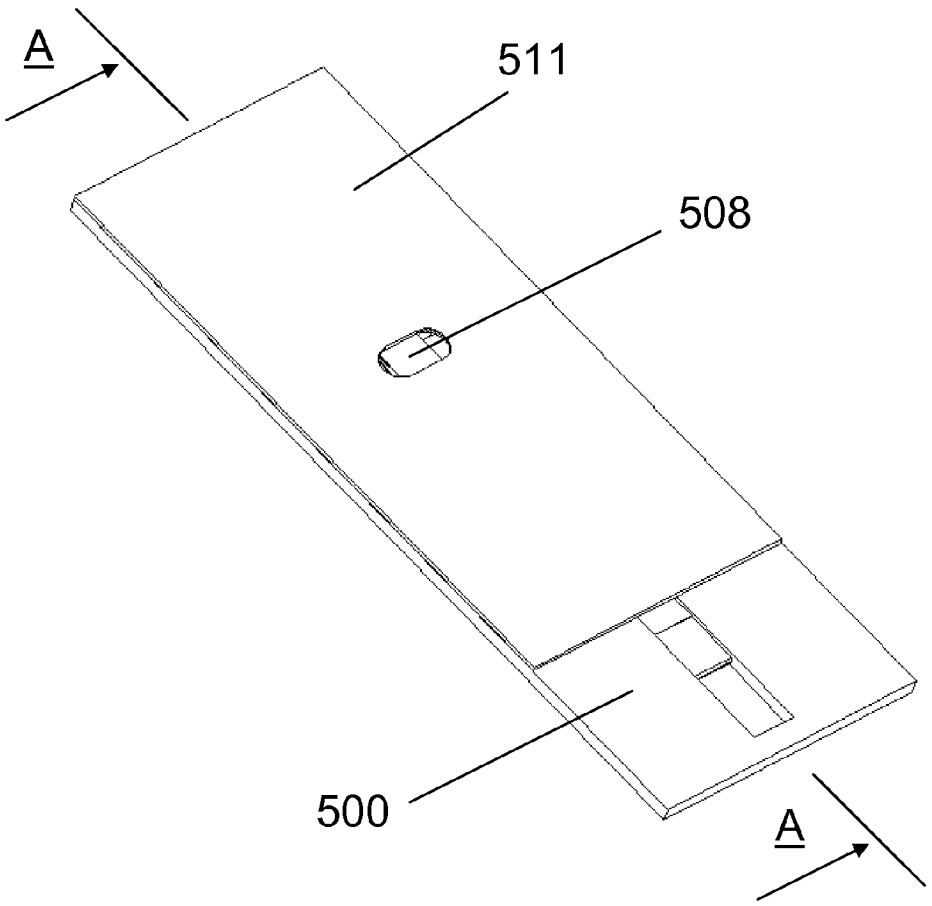
Figure 5D:
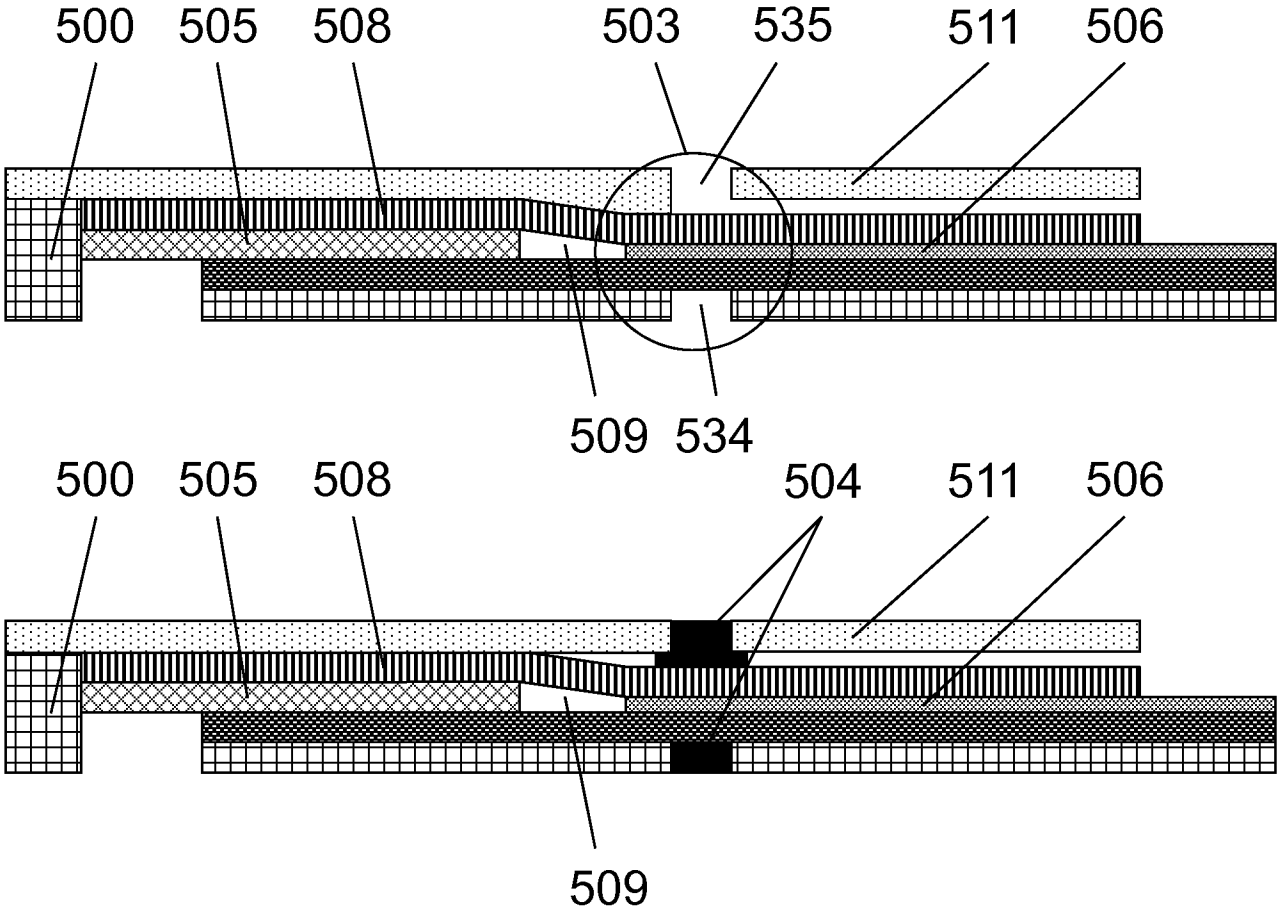

FIGS. 5*a*-5*h* show various embodiments of a fluidic device of the present disclosure. The fluidic device comprises a flow channel (501) with a flow control zone (503) that extends around the sensor membrane (506). The flow control zone (503) comprises a flow control medium (504) which provides the sensor membrane (506) with a water tight enclosure within the flow channel (501). As shown in FIG. 5*a*, the sensor membrane (506) includes one or more capture zones (532). As shown in FIGS. 5*a* and 5*d*, the flow control zone (503) may comprise a cavity (534) that traverses the substrate (500) and intersects the flow channel. In certain embodiments, the flow control zone (503) has a length of about 0.5 mm to about 5 mm and a width of about 2 mm to about 30 mm. In certain embodiments, the flow control zone (503) is located about 1 mm to about 5 mm downstream of the free space diffusion zone (509).

As shown in FIG. 5*d*, in certain embodiments, the flow control medium (504) can be introduced into the flow control zone (503) via the opening of cavity (534) on the lower surface of the substrate (500). As shown in FIGS. 5*c* to 5*f*, in certain embodiments, the fluidic device includes a cover (511) located on the top surface of the substrate (500) that includes an opening (535) over the flow control zone (503) and which enables the introduction of the flow control medium (504) into the flow control zone (503) from the opposite side of the fluidic device. Preferably, the opening (535) has a length of about 0.5 mm to about 3 mm (in the direction of the flow channel) and a width of about 2 mm to about 5 mm (across the flow channel). As shown in FIGS. 5*c* to 5*g*, in certain embodiments, the top support (508) extends over the sensor membrane (506) and reagent pad (505). Conversely and as shown in FIG. 5*h*, in certain embodiments, the top support (508) only covers a portion of the sensor membrane (506). In each case, the top support (508) acts as a fluid impermeable shield, protecting the sensor membrane (506) from possible ingress of the flow control medium (504). As shown in FIG. 5*h*, in some embodiments, a portion (539) of the sensor membrane (506) is disposed upstream of the top support (508), within the free space diffusion zone (509).

In certain embodiments, the flow control medium (504) comprises a material that can be initially dispensed in a liquid phase and subsequently cured or dried to become a solid phase. In certain embodiment, the material has a low shrinkage of less than 1%, a viscosity of 1,000 cP to 20,000 cP, comprises a low fraction of volatile components that could be released during curing or drying and is insoluble and/or hydrophobic. For example, the material may be an adhesive (e.g., a glue), such as a drying adhesive, a contact adhesive, a hot adhesive, an emulsion adhesive, a UV or light curing adhesive, or a pressure sensitive adhesive. In certain embodiments, the material may be an encapsulant, such as filled or un-filled epoxy. Other suitable materials include silicones, natural resins, putty, wax, etc. In one embodiment, the flow control zone (503) may be filled with a UV curing adhesive such as UV epoxy resin. In accordance with this embodiment, a defined amount of adhesive is initially dispensed into the flow control zone (503) through openings in the substrate (500) and the cover (511), and allowed to settle. In a subsequent step the UV curing adhesive is cross-linked and as result hardened by exposure to UV light. In certain embodiments, the UV epoxy resin is suitable for medical device manufacture and has a viscosity of 2,000 cP to 20,000 cP. Examples include, but are not limited to, Dymax 1180-M-T, Dymax 1180-M-VT, Dymax 3013-T, Norland Adhesive NOA63 and Norland Adhesive NOA68.

Figure 5E:
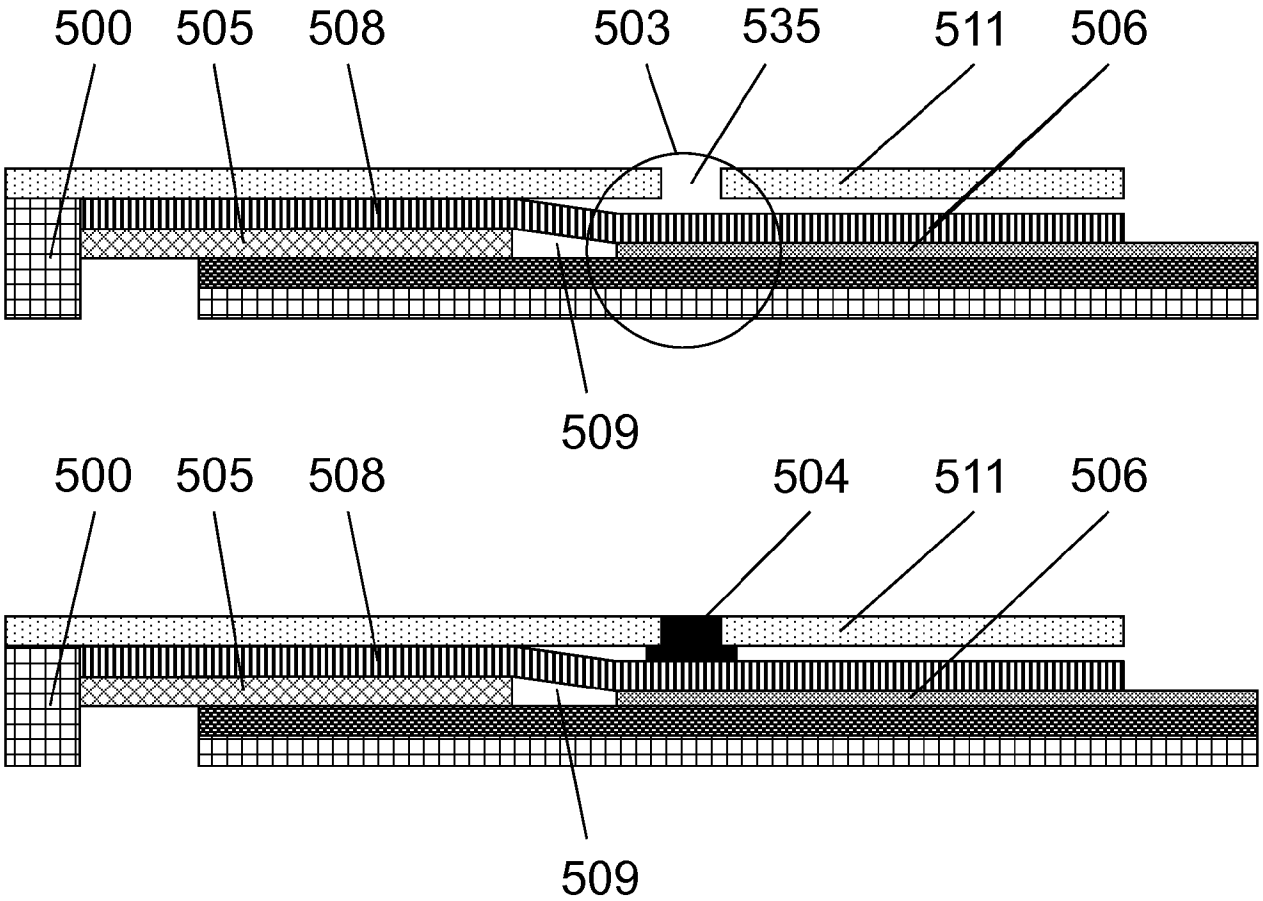
Figure 5F:
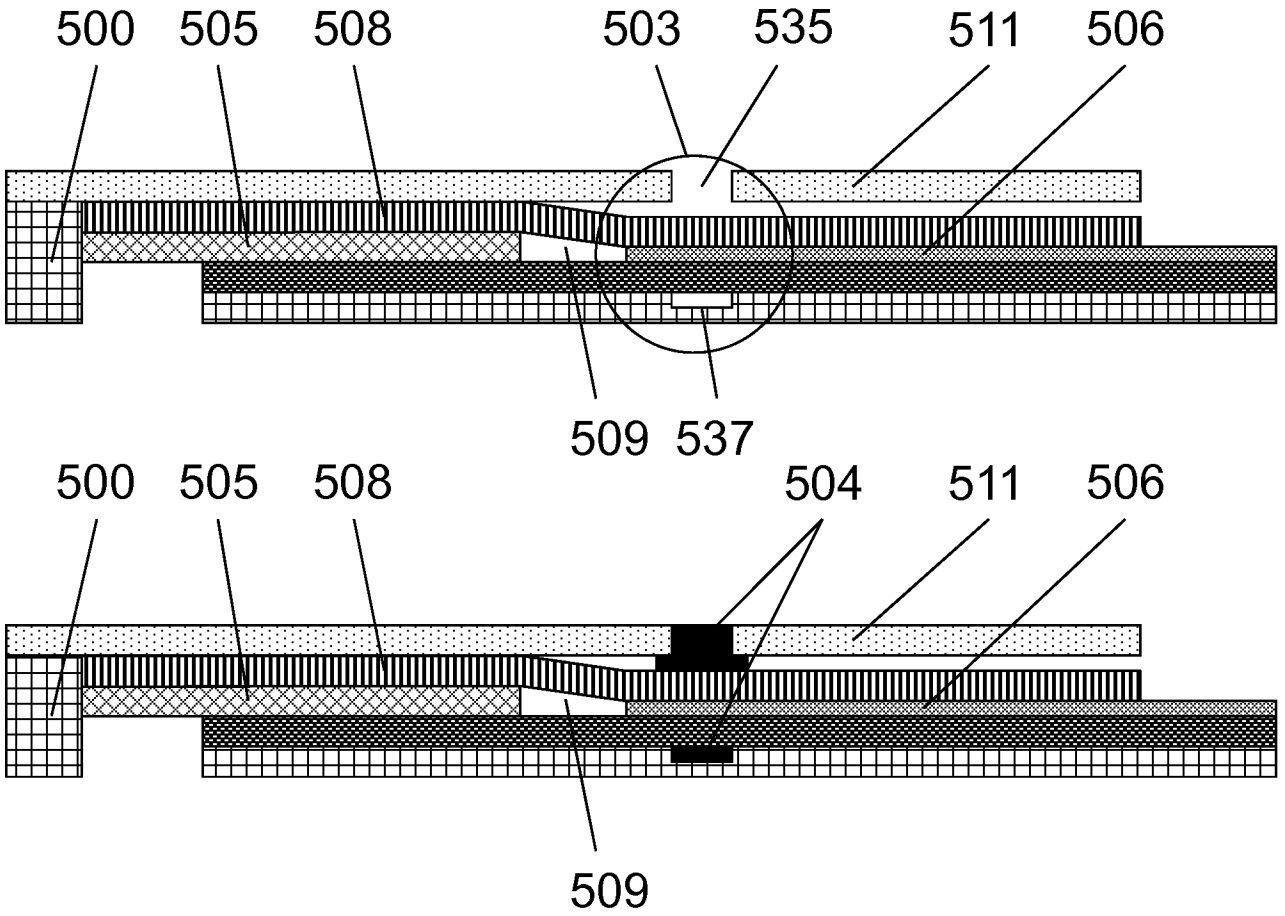
Figure 5G:
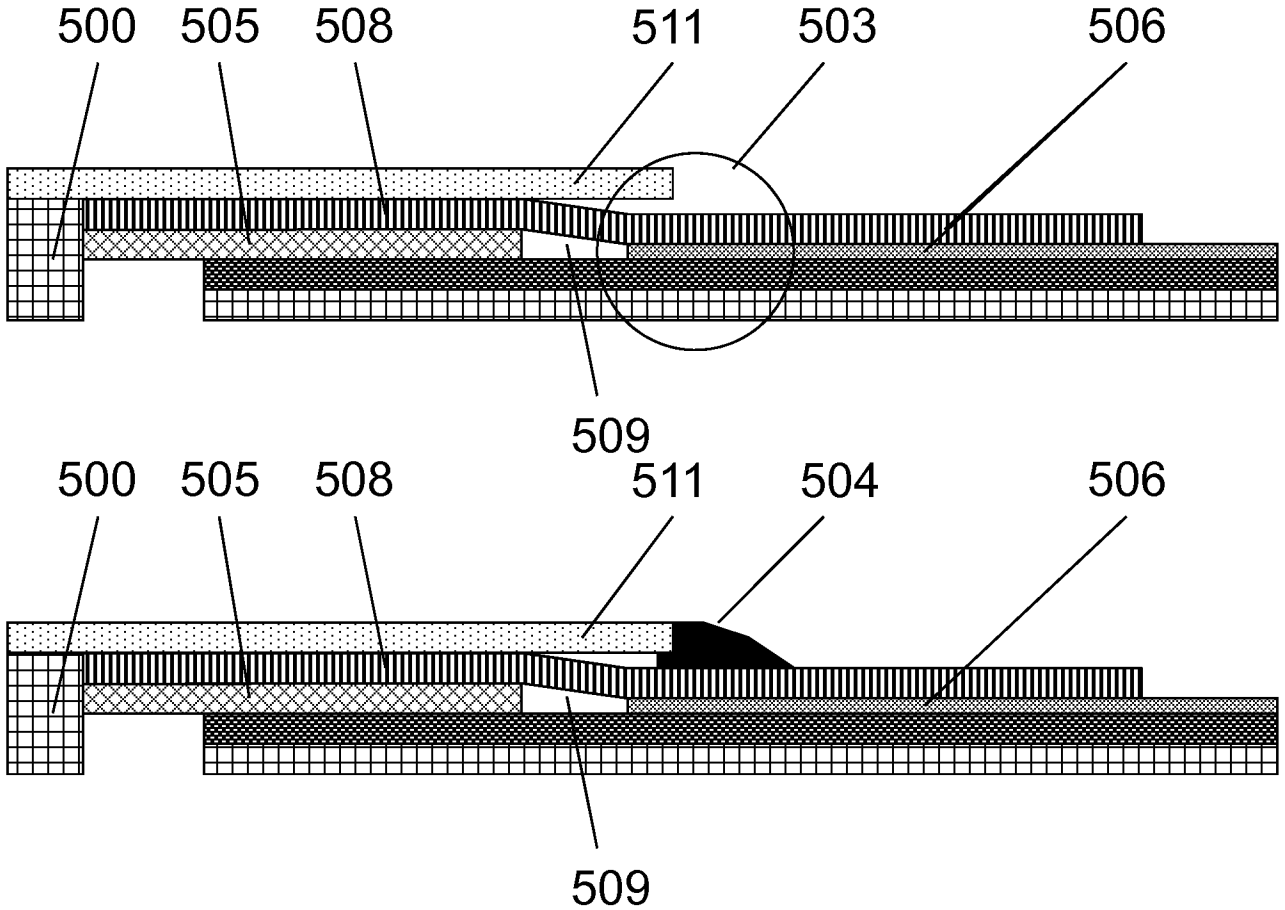
Figure 5H:
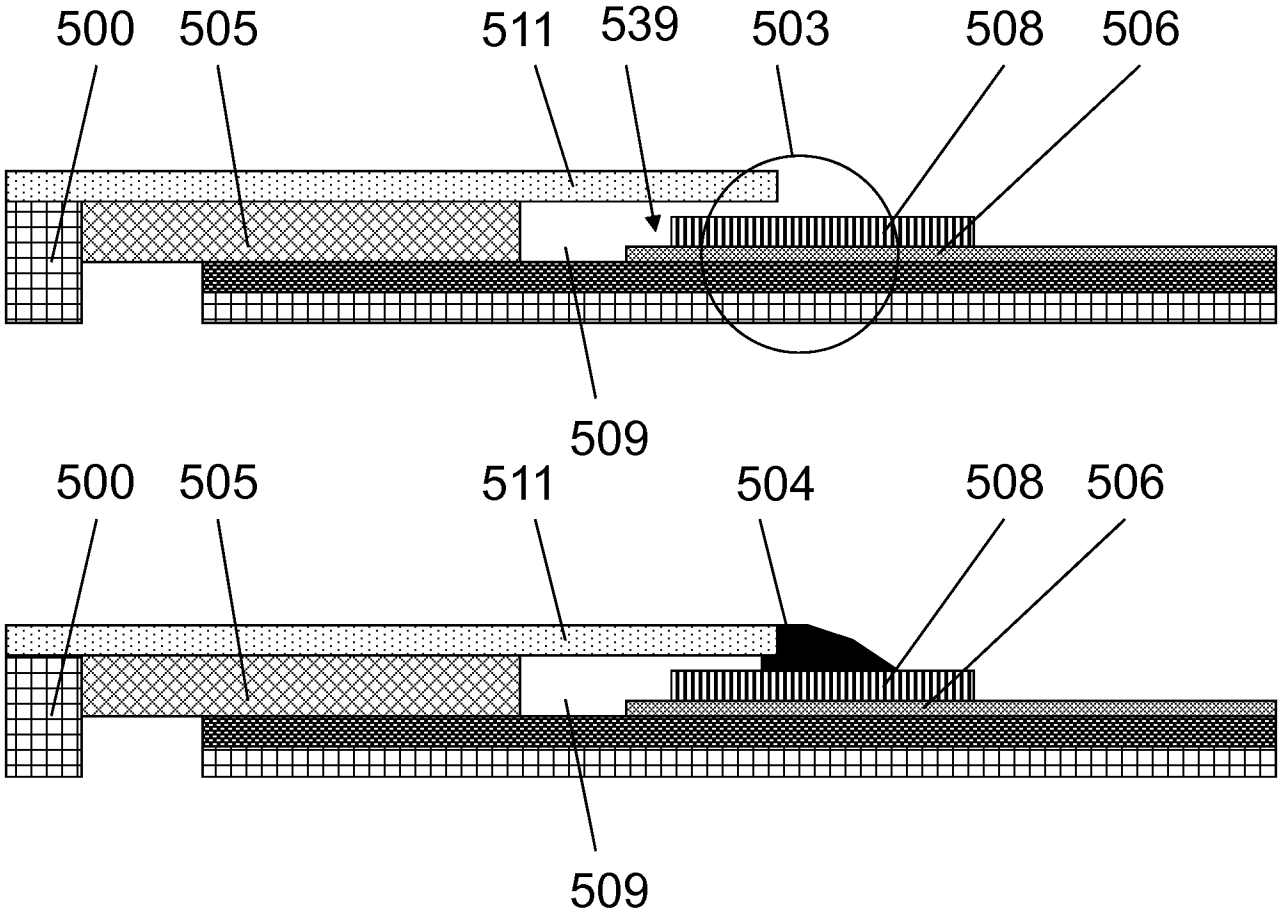

FIGS. 5*d*-5*h* show cross sectional views of alternative flow control zones (503) and the resulting locations and shapes of flow control media (504) after the flow control zones (503) have been filled with the relevant material. FIG. 5*d* provides a flow control zone (503) with a top opening (535) in the cover (511) and a bottom opening (534) in the substrate (500) through which the flow control medium (504) can be dispensed. FIG. 5*e* provides a flow control zone (503) with only a top opening (535) in the cover (511) through which the flow control medium (504) can be dispensed. FIG. 5*f* provides a flow control zone (503) with a top opening (535) in the cover (511) through which the flow control medium (504) can be dispensed and a buried flow cavity (537) into which the flow control medium (504) can then extend (the buried flow cavity (537) is wider than and therefore traverses the flow channel). FIG. 5*g* provides a flow control zone (503) which is only partly sealed with a cover (511). The flow control medium (504) can be inserted into the flow control zone (503) through the exposed section of the flow channel.

The exemplary fluidic devices of FIGS. 3-5 all include flow channels within a substrate (i.e., where the flow channel sits below the surface of the substrate). As discussed in more detail below, it is to be understood that the devices and methods of the present disclosure are not limited to this type of design and can involve flow channels that are defined by walls that rise up from the surface of a substrate (e.g., as shown in FIGS. 10-11).

Cartridge Assemblies

In another aspect, the present disclosure provides cartridge assemblies that include a fluidic device. As shown in FIGS. 6*a*-6*d*, in certain embodiments, the cartridge assembly comprises a fluidic device sandwiched between front (612) and back (613) portions of an enclosure. The enclosure supports the fluidic device in a vertical or angled orientation so that gravity contributes to the flow of fluid sample through the device.

Figure 6A:
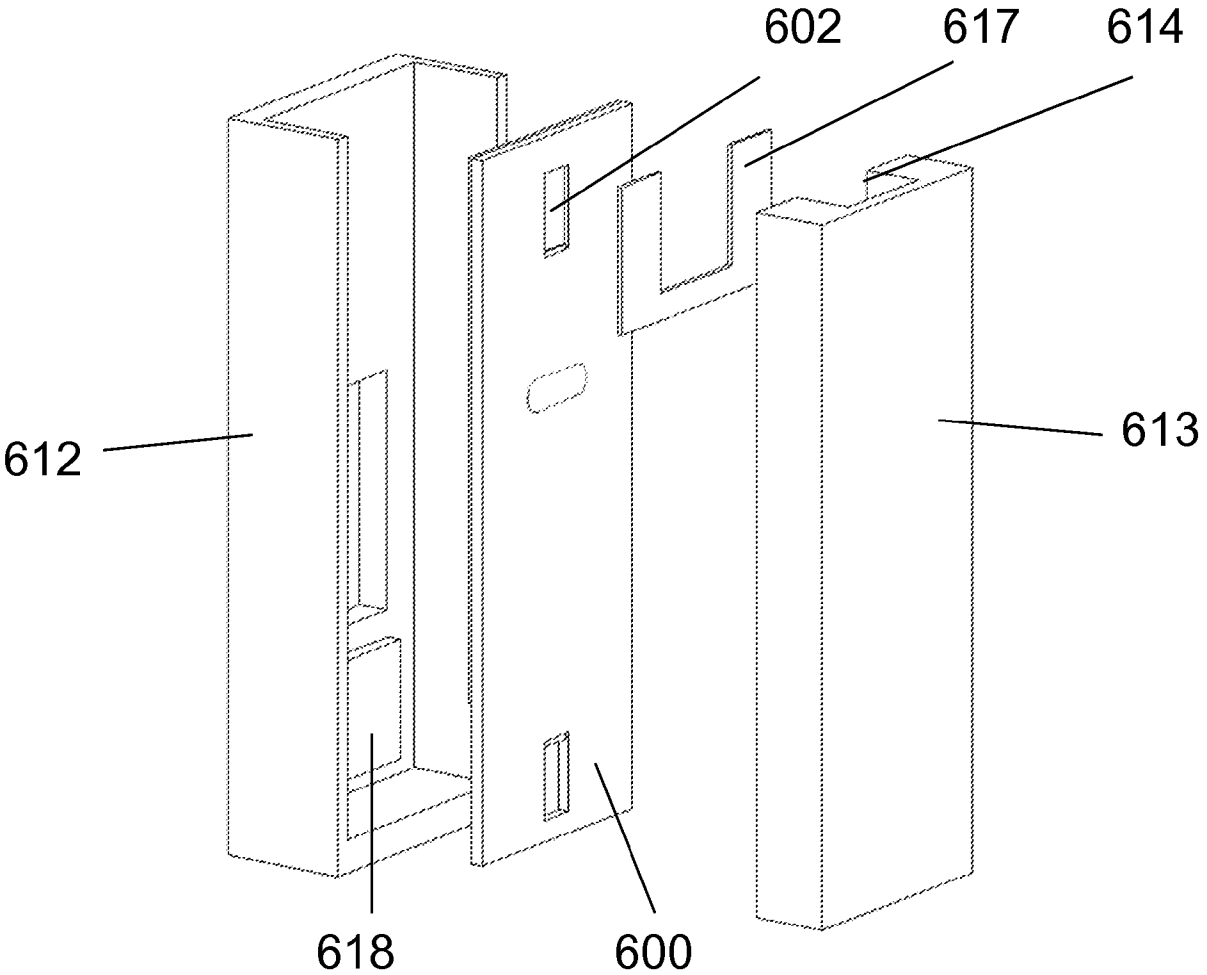
FIGS. 6*a*-6*d* show different views of an exemplary cartridge assembly.
Figure 6B:
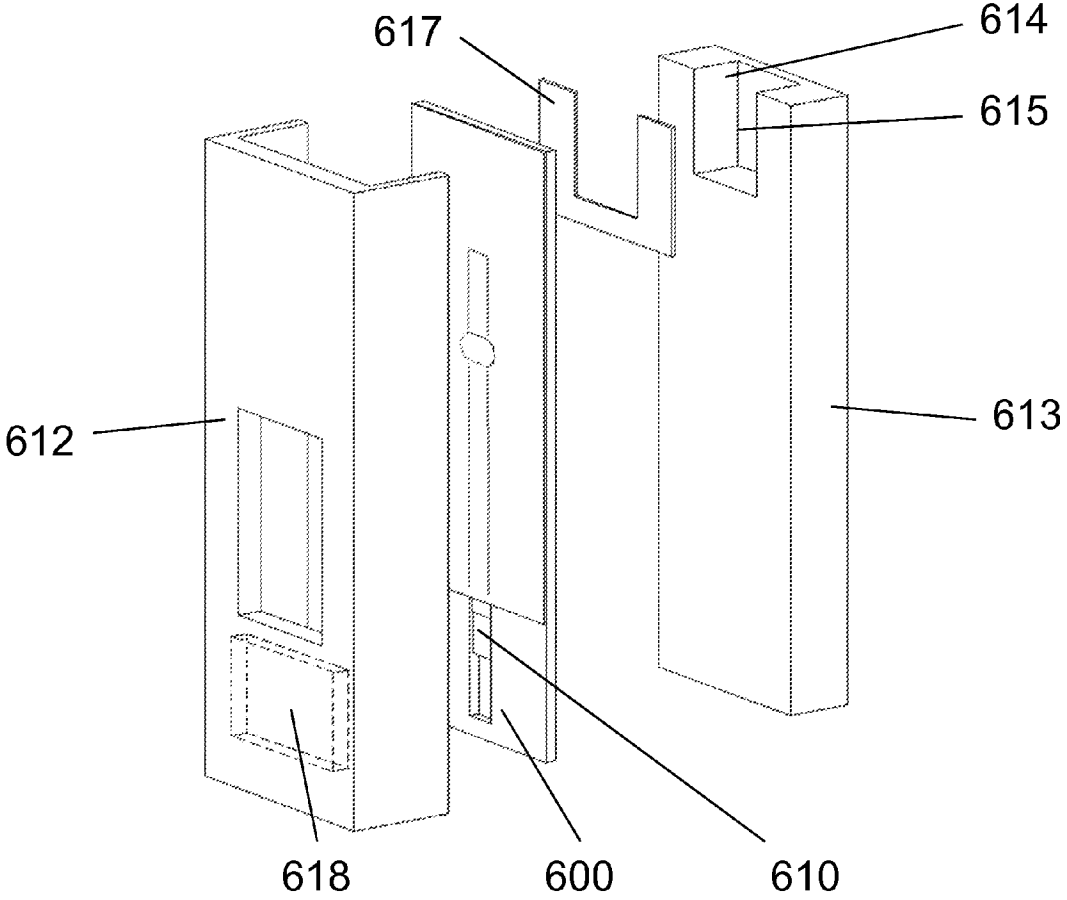
Figure 6C:
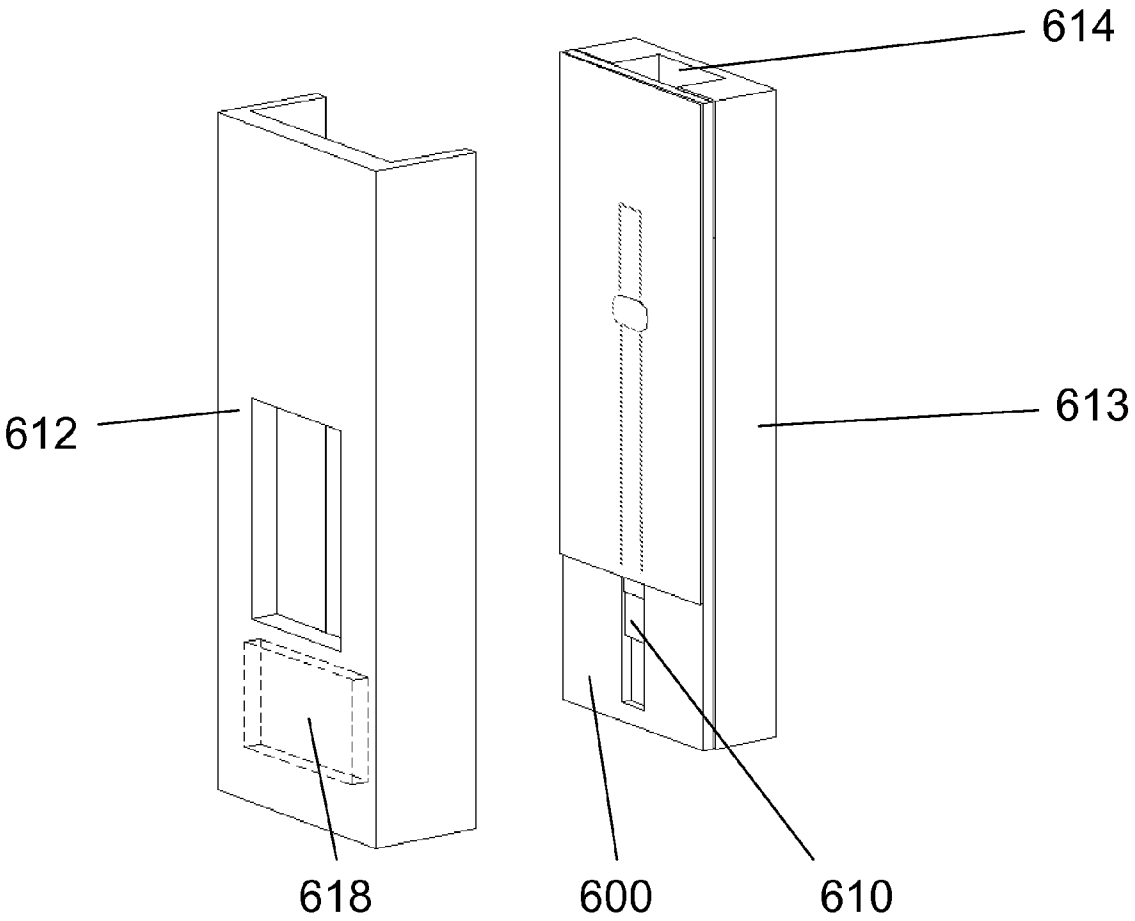
Figure 6D:
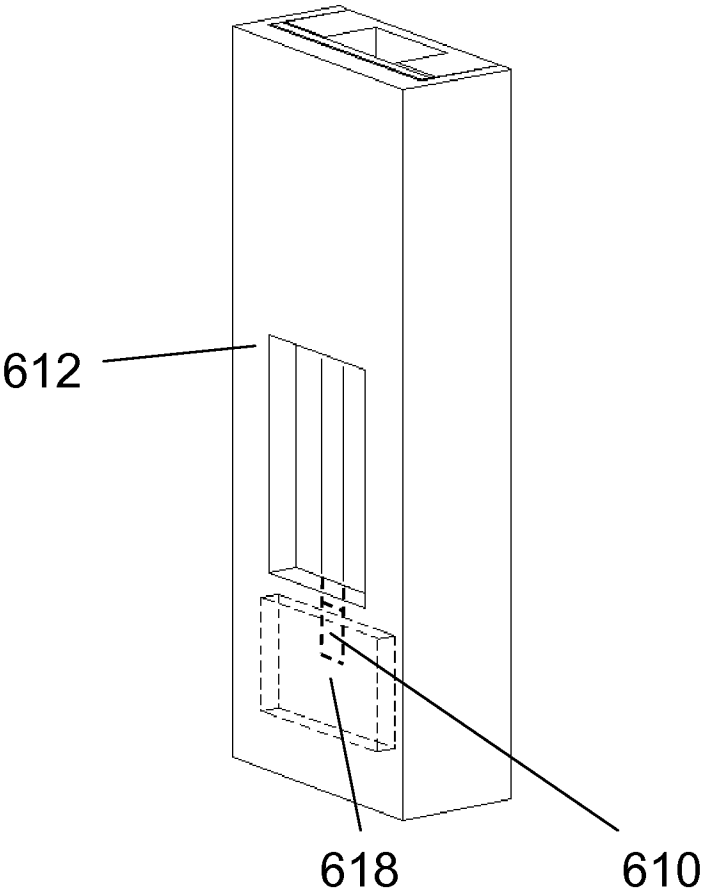

In certain embodiments, the front portion of the enclosure (612) includes an inspection window that allows the capture zone of the sensor membrane of the fluidic device to be inspected. As shown in FIGS. 6*a*-6*d*, the cartridge assembly may also comprise a sample reservoir (615) located between the fluidic device and the rear portion of the enclosure (613). The sample reservoir (615) includes an inlet (614) for receiving the fluid sample. The sample reservoir (615) is in fluidic communication with the flow channel of the fluidic device via an inlet (602) on the lower surface of the substrate (600). As shown in FIGS. 6*c*-6*d*, an absorbent component (618) which is integrated into the front portion of the enclosure (612) is brought into contact with the contact zone (610) of the sensor membrane when the cartridge assembly is assembled. In certain embodiments, the fluidic device is sealed against the rear portion of the enclosure (613) with a water impermeable gasket (617). When present, the gasket (617) comprises adhesive surfaces on its front and rear, which adhere the gasket (617) to the respective surfaces of the fluidic device and the rear portion of the enclosure (613). Exemplary materials that could be used to make a gasket may include cyclic olefin copolymers (COC), polyethylene terephthalates (PET), polyvinyl chloride (PVC), polystyrene (PS), polyimide, polycarbonates, polyethylene (PE), ethylene vinyl acetate (EVA), polypropylene (PP), Polymethyl methacrylates (PMMA), rubber and paper based materials, etc. Exemplary materials that could be used to provide an adhesive surface to either side of the gasket may include a drying adhesive, a contact adhesive, a hot adhesive, an emulsion adhesive, a UV or light curing adhesive, or a pressure sensitive adhesive, such as acrylic based pressure sensitive adhesives.

Figure 7:
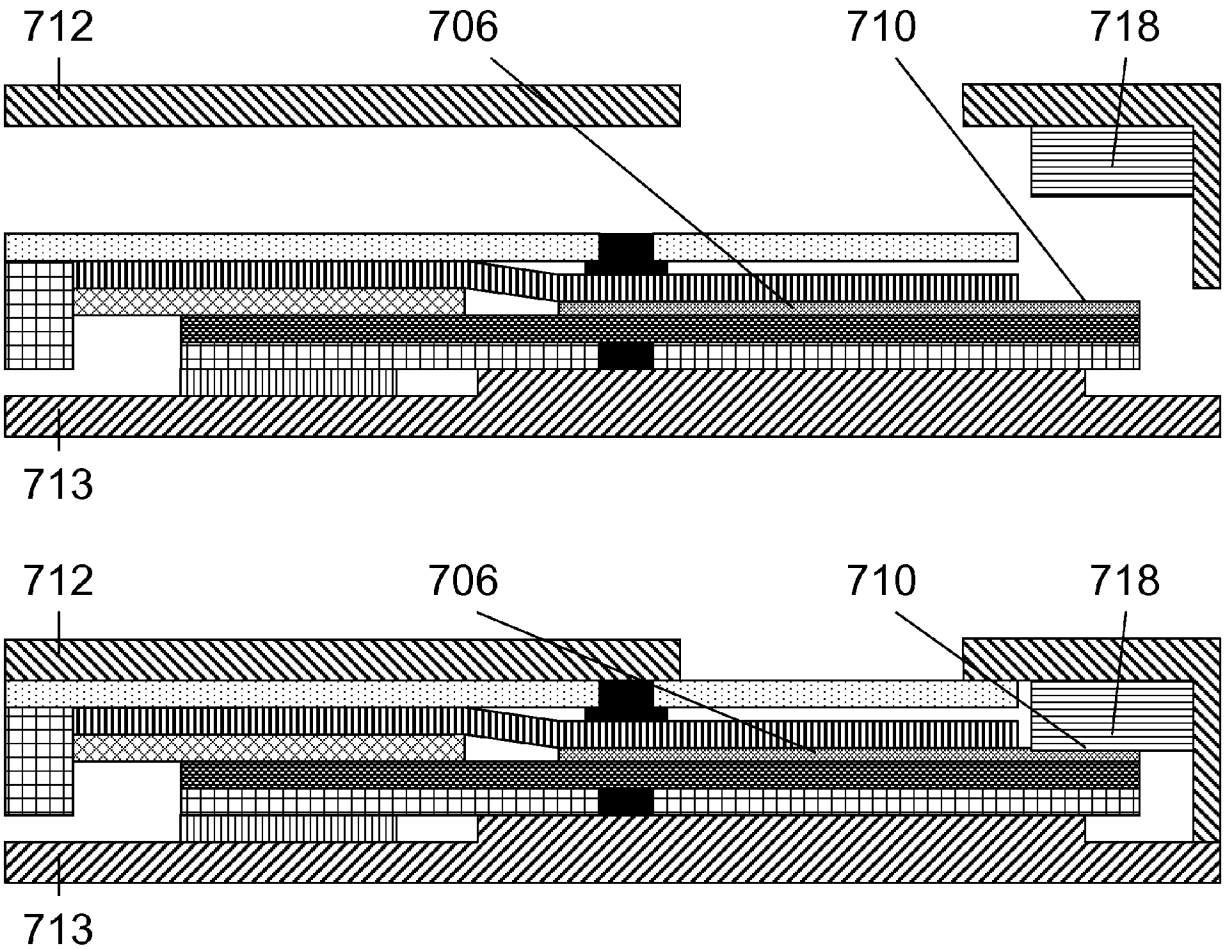
FIG. 7 shows a cross-sectional view of an exemplary cartridge assembly.

FIG. 7 shows a cross sectional view of an embodiment of the cartridge assembly before and after final assembly. As shown, the fluidic device comprises a sensor membrane (706), a flow channel for guiding a fluid sample to the sensor membrane (706), a reagent pad located within the flow channel upstream from the sensor membrane (706), a cover for sealing the reagent pad and part of the sensor membrane (706) within the flow channel, and a flow control zone extending around the sensor membrane (706) for guiding the fluid sample to and through the sensor membrane (706). The sensor membrane (706) comprises an exposed downstream contact zone (710) where the sensor membrane (706) can be contacted with an absorbent component (718) for a controlled fluid removal. The absorbent component (718) is an integral part of the front portion of the enclosure (712). Its location within the front portion of the enclosure (712) is such that when the front (712) and back (713) portions of the enclosure and the fluidic device are assembled, the absorbent component (718) is in contact with the contact zone (710) of the sensor membrane (706).

In certain embodiments, the absorbent component (718) is made of a material that absorbs fluid from the contact zone (710). In certain embodiments, the absorbent component (718) is sufficiently large to ensure absorbent capacity adequate for the collection of the entire fluid sample. In general, the absorbent component (718) may be a synthetic or natural bulk material, a woven or non-woven fiber or a reticulated or open cell foam structure. Examples of suitable absorbent component materials include, but are not limited to, cellulose materials, cotton fiber, glass microfiber, polyester, polyester polyurethane, polyimide, or melamine resin. In certain embodiments, the absorbent component (718) is about 5 mm to about 25 mm in length, about 5 mm to about 35 mm in width and about 0.3 mm to 2 mm in thickness. In certain embodiments, the contact area between the absorbent component (718) and the contact zone (710) of the sensor membrane (706) is about 1 mm to about 10 mm in length, and substantially similar in width to the width of the sensor membrane (706).

In certain embodiments, each absorbent component (718) is about 10 mm in length, about 15 mm in width and about 1.5 mm in thickness. In such embodiments, the contact area between the absorbent component (718) and the contact zone (710) of the sensor membrane (706) may be in the range of about 3 mm to about 5 mm in length and substantially similar in width to the width of the sensor membrane (706).

Figure 8A:
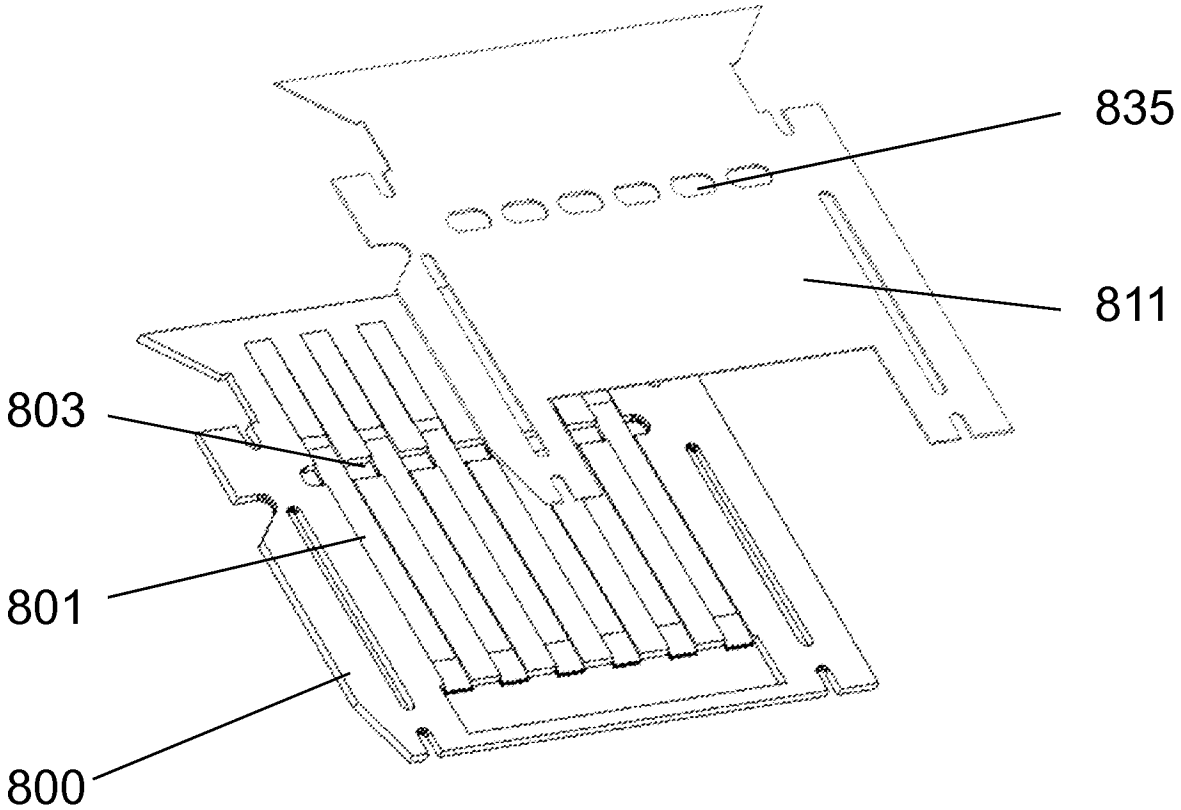
FIGS. 8*a*-8*c* show different views of an exemplary fluidic device.
Figure 8B:
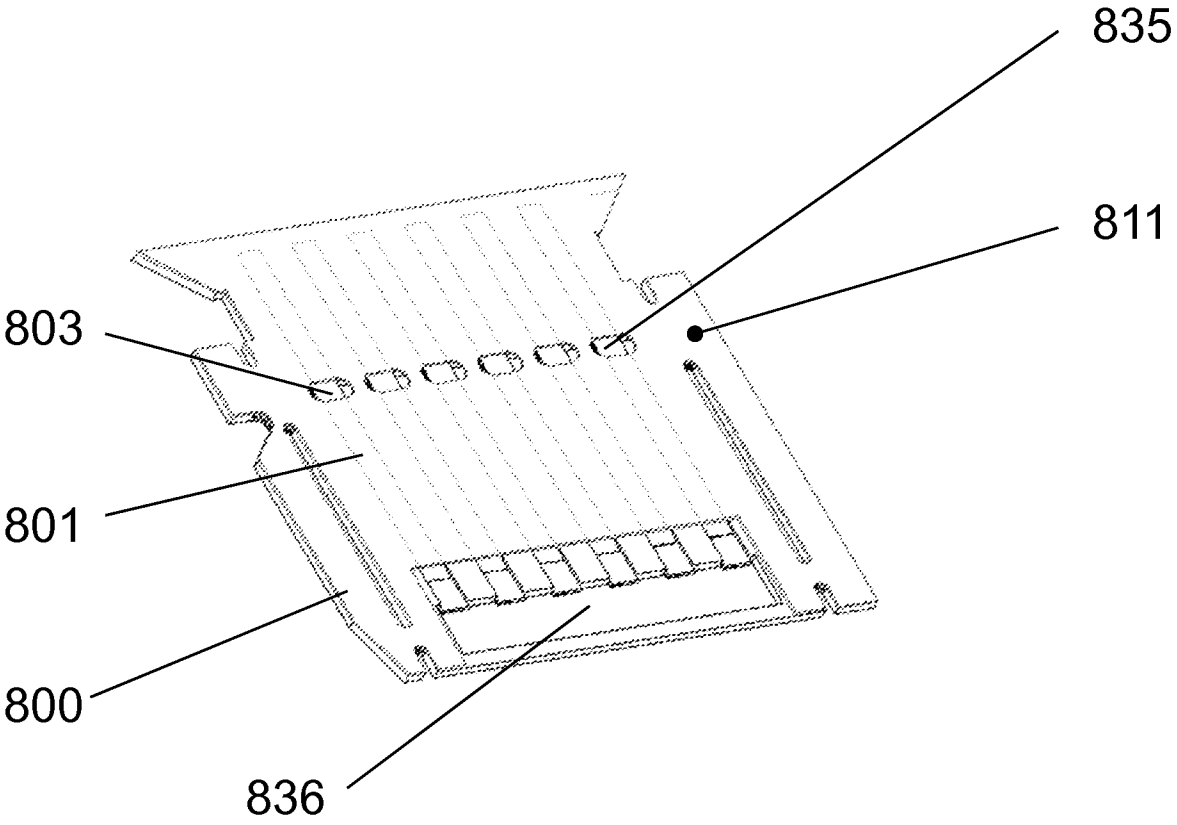
Figure 8C:
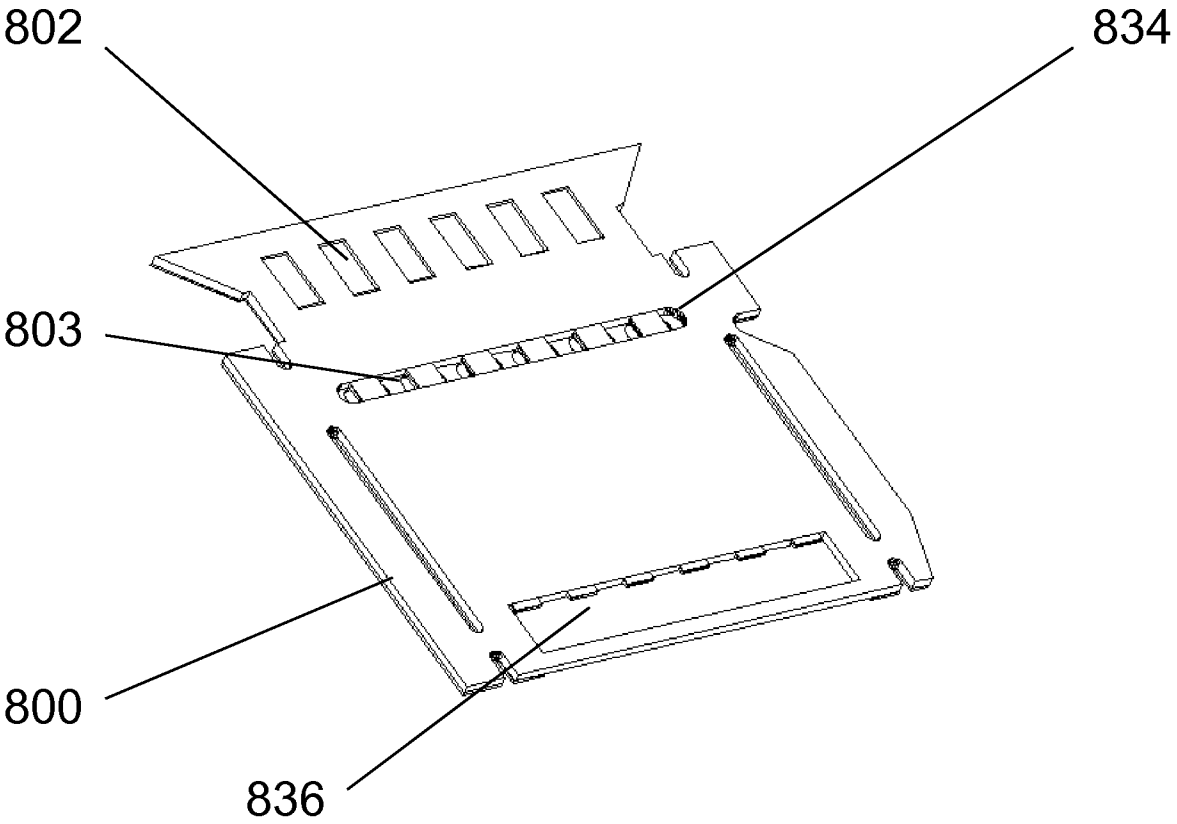

FIGS. 8*a*-8*c* show an exemplary fluidic device that comprises six separate flow channels. FIGS. 9*a*-9*d* show how this exemplary fluidic device can be assembled into a cartridge assembly. Referring to FIG. 8*a*, the substrate (800) of the fluidic device comprises six separate flow channels (801) and a single cover (811). The cover (811) ensures that the flow channels (801) remain separate without sample cross-over. In certain embodiments, the cover (811) is composed of a material with good optical transparency. Each flow channel (801) has a length of about 25 mm to about 75 mm, a width of about 1.3 mm to about 5 mm, and a depth of about 0.3 mm to about 1.0 mm. Each flow channel (801) comprises an inlet (802) upstream from a reagent pad and sensor membrane for receiving a fluid sample. Preferably, the inlet (802) has a length of about 1 mm to about 5 mm and a width of about 1.3 mm to about 5 mm. In certain embodiments, the inlet (802) has substantially the same width as the flow channel (801). The fluidic device also comprises an exit (836) at the downstream end of each flow channel (801). As shown in FIG. 8*b*, this exit (836) may be defined as a cavity that traverses the substrate (800) and cover (811) and which also corresponds with the downstream sections of each of the flow channels (801). In certain embodiments, the exit (836) is about 3 mm to about 10 mm in length and about 5 mm to about 35 mm in width.

The fluidic device in FIGS. 8*a*-8*c* comprises a flow control zone (803) extending around each of the sensor membranes (806). The flow control zone (803) comprises a flow control medium (804), which provides each of the sensor membranes (806) with a water tight enclosure within their respective flow channels (801). As shown in FIG. 8*a*, the flow control zone (803) may comprise one continuous cavity that traverses the substrate (800) and intersects with all of the flow channels (801). In certain embodiments, the flow control zone (803) has a length of about 0.5 mm to about 3 mm and a width of about 2 mm to about 35 mm. In certain embodiments, the flow control zone (803) is aligned about 1 mm to about 5 mm downstream of the free space diffusion zone (809).

As shown in FIG. 8*c*, the fluidic device may comprise a continuous opening (834) in the bottom surface of the substrate (800) which enables the insertion of flow control medium (804) into the flow control zone (803). In certain embodiments, instead of a single continuous opening, separate openings are used to fill flow control zones for each flow channel (801). In certain embodiments the opening(s) have a length of about 0.5 mm to about 3 mm and a width of about 2 mm to about 35 mm. As shown in FIG. 8*b*, the fluidic device may also comprise openings (835) in the cover (811) which enable the insertion of flow control medium (804) into the flow control zone (803) from the opposite side of the fluidic device. In certain embodiments a single contiguous opening in the cover (811) may be used instead of separate openings. In certain embodiments, each opening has a length of about 0.5 mm to about 3 mm (in the direction of the flow channel) and a width of about 2 mm to about 5 mm (across the flow channel).

In some embodiments, the fluidic device of FIGS. 8*a*-8*c* is configured as follows. The flow channels (801) each have a length of about 40 mm, a width of about 2.5 mm or about 4 mm, and a depth of about 0.6 mm. Each flow channel inlet (802) has a length of about 5 mm and a width of about 2.5 mm or about 4 mm. In certain embodiments, the width of each flow channel inlet (802) is substantially the same as the width of each flow channel (801). The flow channel (801) comprises an exit (836) at the downstream end. This exit (836) is an opening in the bottom surface of the substrate (800). The exit (836) is about 7 mm in length and about 2.5 mm or about 40 mm in width. The flow control zone (803) has a length of about 2 mm, a width of about 35 mm, traverses the substrate (800) and intersects each of the flow channels (801). In certain embodiments, the flow control zone (803) is aligned 1 mm below the free space diffusion zone in the fluidic device. The fluidic device further comprises openings (835) in the cover (811) which correspond with the position of the flow control zones (803) in each of the flow channels (801), and which have a length of about 2 mm (in the direction of the flow channel) and a width of about 4 mm (across the flow channel).

The fluidic device of FIGS. 8*a*-8*c* may be assembled into a cartridge assembly as shown in FIGS. 9*a*-9*d*. In general, the fluidic device is sandwiched between the front (912) and rear (913) portions of an enclosure. The enclosure supports the fluidic device in a vertical or angled orientation so that gravity contributes to the flow of fluid sample through the device. The assembly is similar to the assembly of FIG. 6 that was discussed above and therefore certain features will not be repeated. Thus, in certain embodiments, the front portion of the enclosure (912) includes an inspection window that allows the capture zones of the sensor membranes of the fluidic device to be inspected. As shown in FIGS. 9*b*-9*e*, the cartridge assembly comprises a sample reservoir (915) located between the fluidic device and the rear portion of the enclosure (913). The sample reservoir (915) includes an inlet (914) for receiving the fluid sample. The sample reservoir (915) is in fluidic communication with the flow channels of the fluidic device via inlets on the lower surface of the substrate (900). In certain embodiments, the sample reservoir (915) is about 10 mm to about 20 mm in length, about 20 mm to about 35 mm in width and about 1 mm to about 3 mm in depth.

Figure 9A:
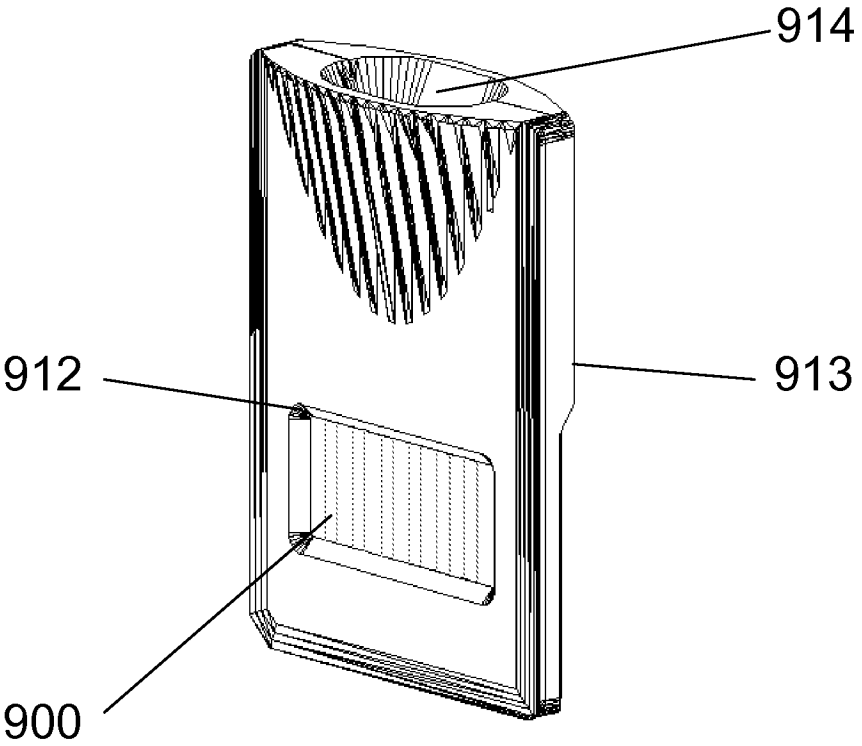
FIGS. 9*a*-9*d* show different views of an exemplary fluidic device and cartridge assembly.
Figure 9B:
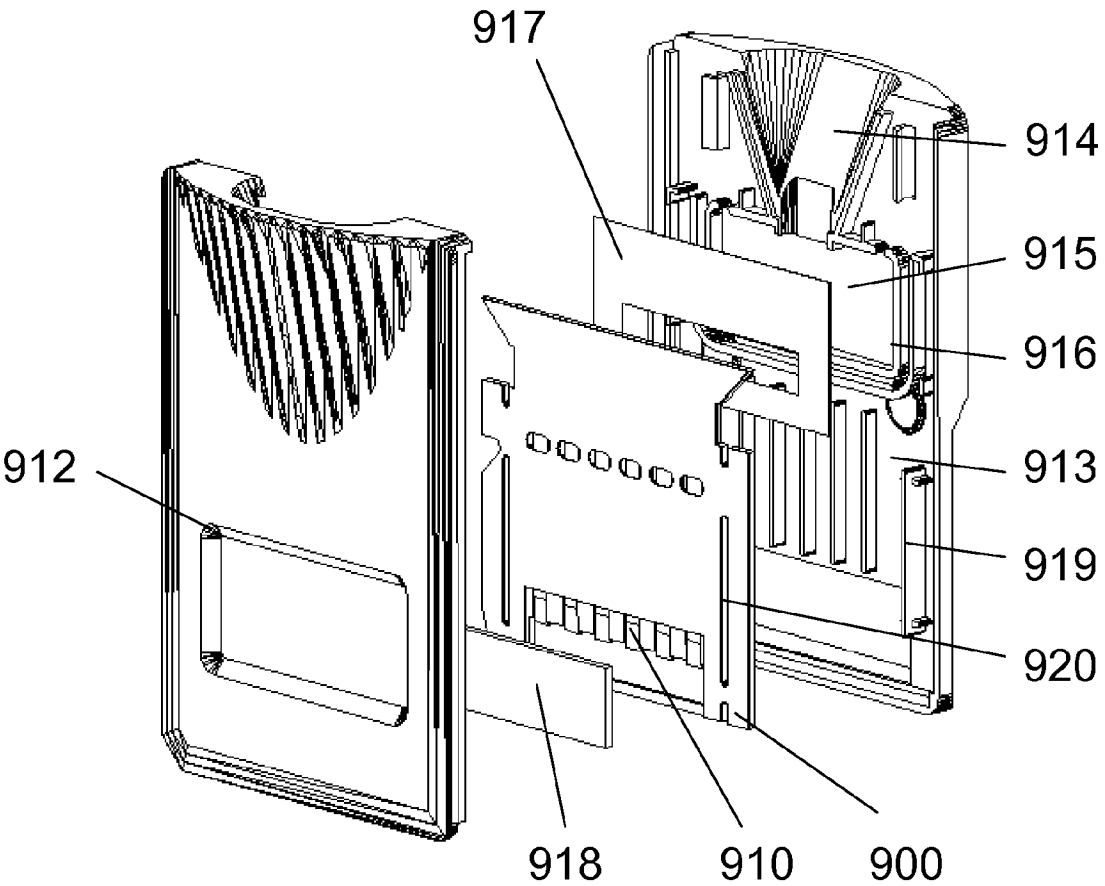

As shown in FIG. 9*b*, an absorbent component (918) which is integrated into the front portion of the enclosure (912) is brought into contact with the contact zones (910) of the sensor membranes when the cartridge assembly is assembled. In certain embodiments, the fluidic device is sealed against the rear portion of the enclosure (913) with a water impermeable gasket (917). When present, the gasket (917) comprises adhesive surfaces on its front and rear which adhere the gasket (917) to the respective surfaces of the fluidic device and the rear portion of the enclosure (913). Exemplary materials that could be used to make a gasket may include cyclic olefin copolymers (COC), polyethylene terephthalates (PET), polyvinyl chloride (PVC), polystyrene (PS), polyimide, polycarbonates, polyethylene (PE), ethylene vinyl acetate (EVA), polypropylene (PP), Polymethyl methacrylates (PMMA), rubber and paper based materials, etc. Exemplary materials that could be used to provide an adhesive surface to either side of the gasket may include a drying adhesive, a contact adhesive, a hot adhesive, an emulsion adhesive, a UV or light curing adhesive, or a pressure sensitive adhesive, such as acrylic based pressure sensitive adhesives.

Figure 9C:
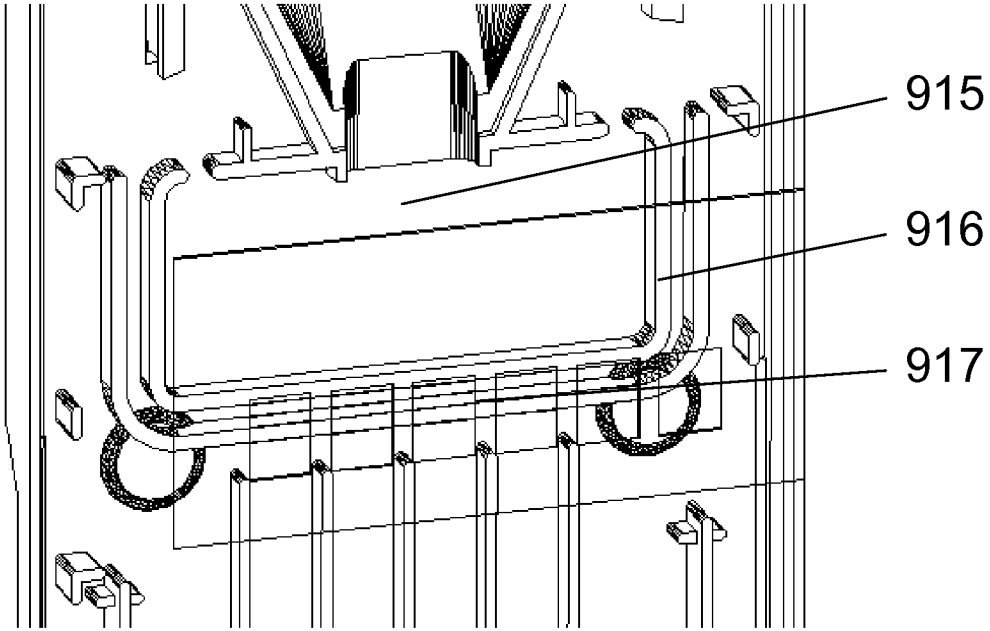
Figure 9D:
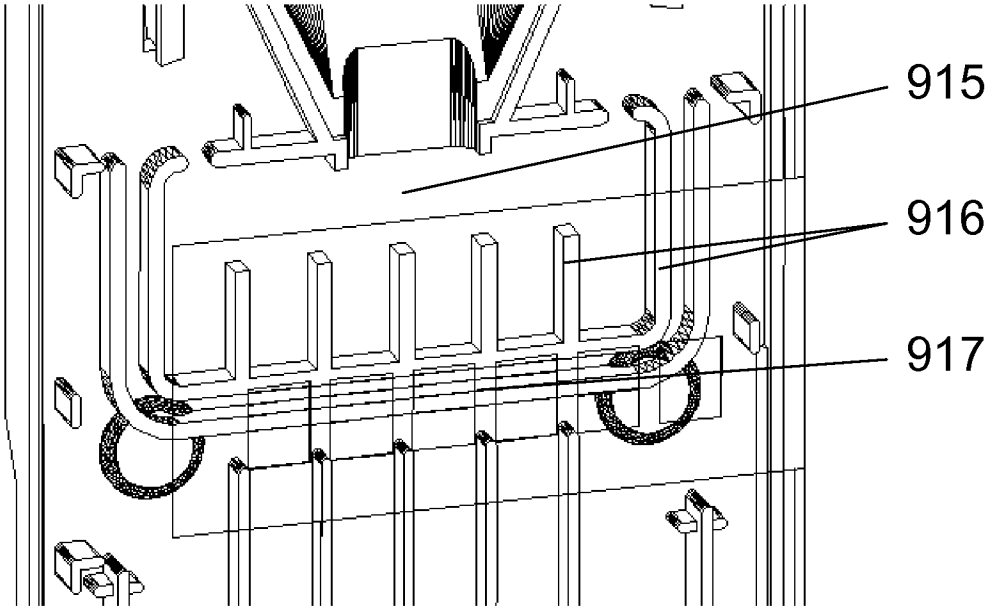

In one embodiment, the sample reservoir (915) is made of a single undivided chamber that provides the fluid sample to the row of separate flow channels (see FIG. 9*c*). In an alternative embodiment, the sample reservoir (915) includes baffles (916) that serve to divide and steer the fluid sample into different flow channel inlets (see FIG. 9*d*). For example, in certain embodiments, each sample reservoir division is about 5 mm to about 15 mm in length, about 2 mm to about 6 mm in width and about 1 mm to about 3 mm in depth. In certain embodiments, the sample reservoir may include baffles (916) that define overflow chambers for collecting excess fluid sample so that only a precisely defined amount of fluid sample is utilised for the assay run within each flow channel. FIG. 9*e* shows one such embodiment where the sample reservoir (915) comprises external overflow compartments (921) to accommodate excess fluid sample. For example, in certain embodiments, an overflow compartment (921) may surround the sample reservoir (915) in order to capture overflowing excess fluid sample, and may be about 15 mm to about 25 mm in length, about 25 mm to about 40 mm in width, and about 1 mm to about 3 mm in depth.

As shown in FIG. 9*b*, in certain embodiments, in order to ensure proper alignment and assembly, the rear portion of the enclosure (913) comprises two alignment pins (919) that correspond with alignment sockets (920) of the fluidic device. Alternative alignment aids will be readily apparent to one skilled in the art.

Figure 10A:
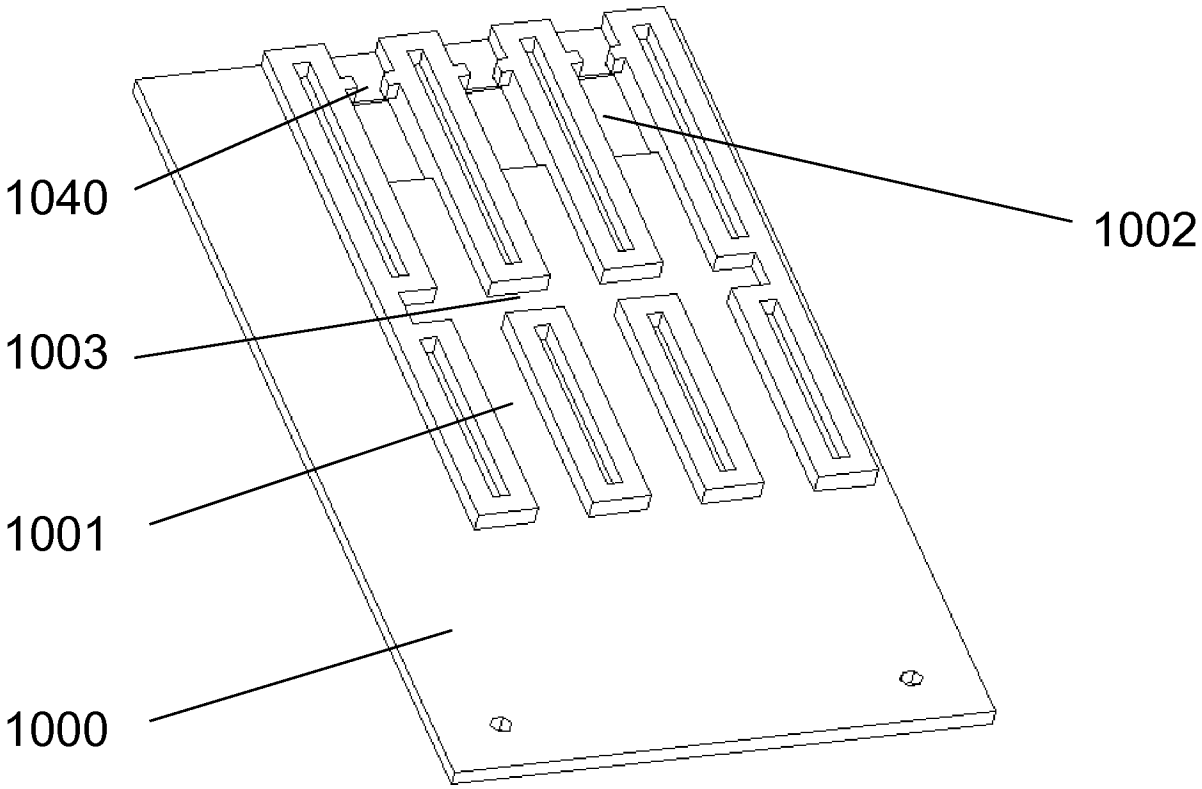
FIGS. 10*a*-10*c* show different views of an exemplary fluidic device and cartridge assembly.
Figure 10B:
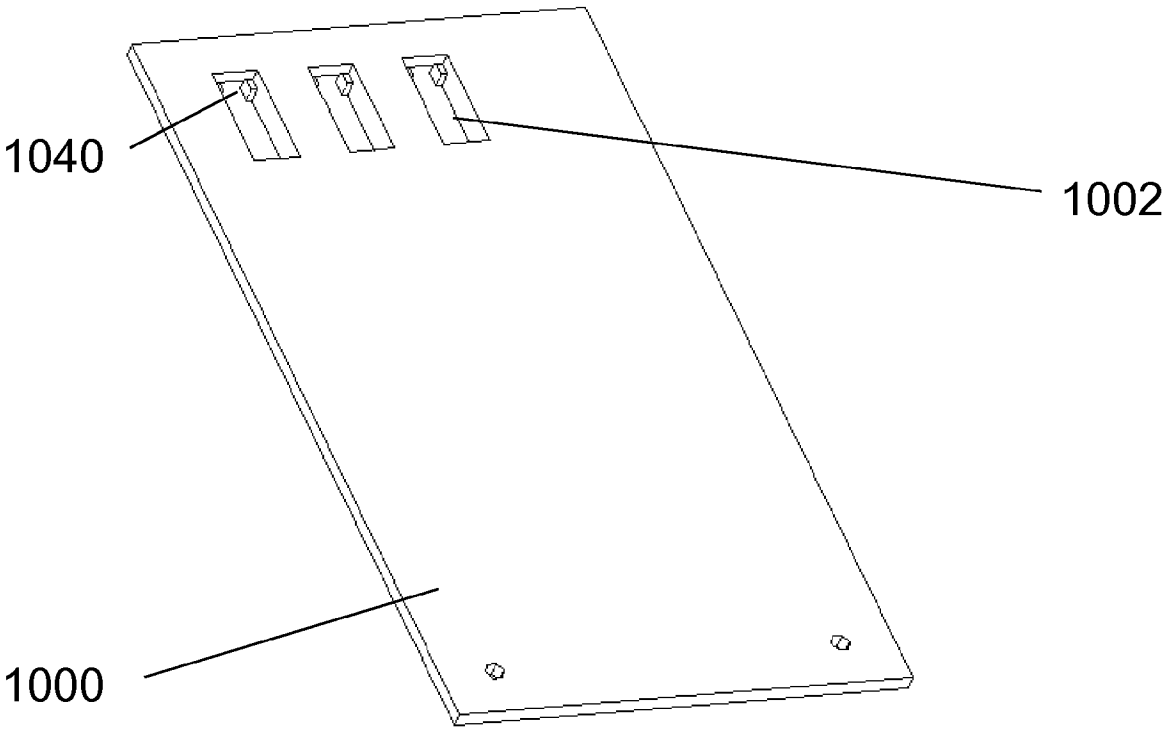
Figure 10C:
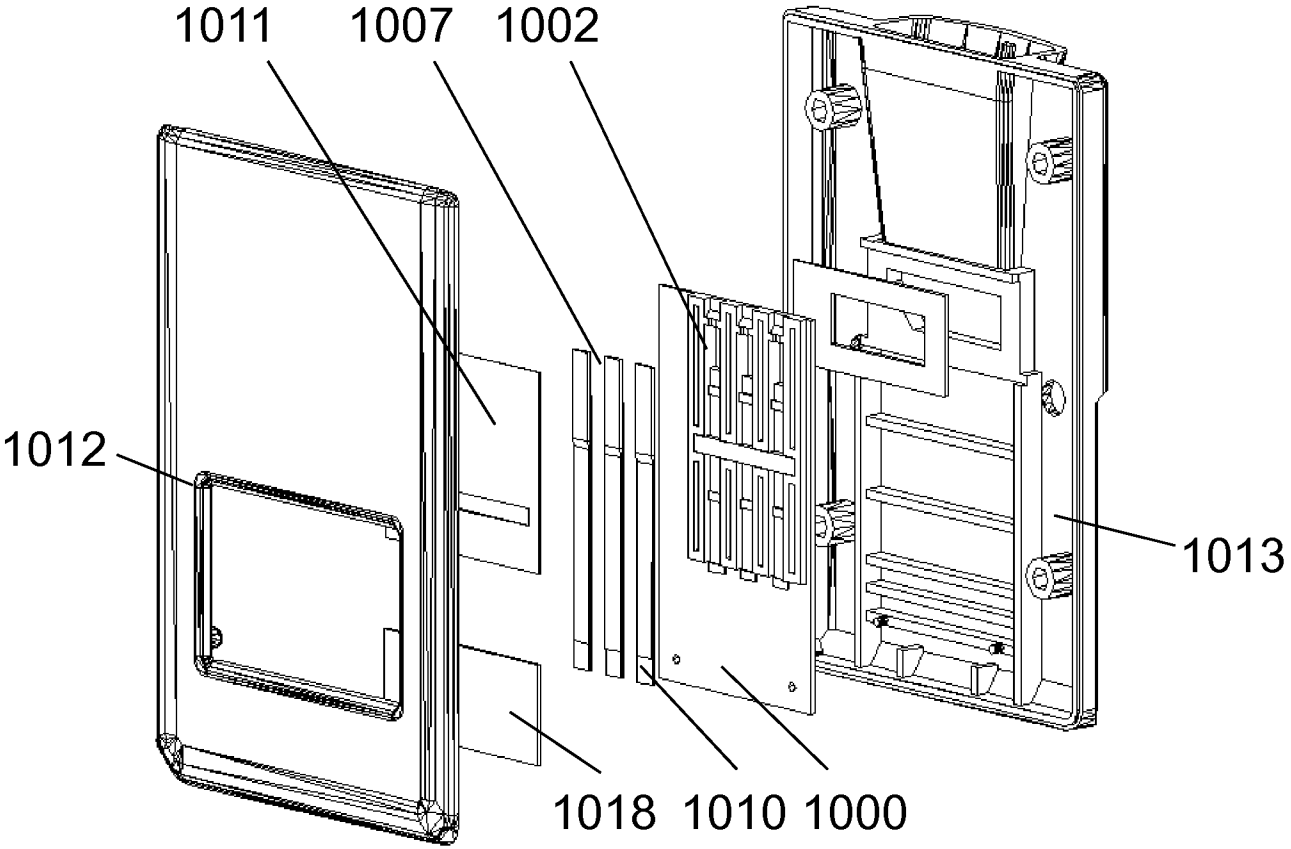

FIGS. 10*a*-10*b* show an exemplary fluidic device with flow channels (1001) defined by walls that rise up (instead of down) from the upper surface of a substrate (1000). The fluidic device in FIGS. 10*a*-10*b* comprises three flow channels (1001) and a flow control zone (1003) in the form of a chamber that intersects each of the flow channels (1001). In certain embodiments, the upstream wall of the flow channel may include a vent (1040), which enables release of trapped air from the reagent pad and thereby aids uniform sample flow into the reagent pad. It is to be understood that any number of flow channels could be included in a fluidic device (e.g., 1, 2, 3, 4, 5, 6, 7, 8 or more). As shown in FIG. 10*c*, and as discussed in more detail above, reagent pads and sensor membranes that have been assembled on bottom supports (1007) and sealed with a top support are placed within each flow channel. A cover (1011) ensures the flow channels (1001) are kept separate without possibility of sample cross-over. In certain embodiments, each flow channel (1001) has a length of about 25 mm to about 75 mm, a width of about 1.3 mm to about 5 mm, and a height of about 0.3 mm to about 1.0 mm. Each flow channel comprises an inlet (1002) upstream from the reagent pad and sensor membrane for receiving a fluid sample. In certain embodiments, the inlet (1002) has a length of about 1 mm to about 5 mm, a width of about 1.3 mm to about 5 mm. In certain embodiments, the inlet (1002) has substantially the same width as the flow channel (1001).

As shown in FIG. 10*c*, the fluidic device comprises an exit at the downstream end of each flow channel. This exit is defined as an exposed downstream section of the flow channel, which is not covered by the cover (1011). The cover (1011) includes an opening (1035) that corresponds with the position of the flow control zone (1003) of each flow channel (1001) and enables the insertion of the flow control medium into each of the flow control zones (1003). In certain embodiments, the flow control zone (1003) has a length of about 2 mm, a width of about 30-35 mm, traverses the substrate (1000) and intersects each of the flow channels (1001). In certain embodiments, the flow control zone (1003) is aligned 1 mm downstream of the free space diffusion zone in the fluidic device. In certain embodiments, the opening (1035) in the cover (1011) has a length of about 1 mm to about 3 mm (in the direction of the flow channels) and a width of about 4 mm to about 35 mm (across the flow channels). The opening (1035) in FIG. 10*c* is shown as a single continuous opening; however, it will be appreciated that several separate openings for each flow control zone could be used instead of a single continuous opening (1035).

As shown in FIG. 10*c*, the fluidic device can be sandwiched between the front (1012) and rear (1013) portions of an enclosure to form a cartridge assembly. The enclosure supports the fluidic device in a vertical or angled orientation so that gravity contributes to the flow of fluid sample through the device. The assembly is constructed and operates in the same way as the assemblies of FIGS. 6 and 9 that were discussed above. For example, as shown in FIG. 10*c*, each sensor membrane may comprise a contact zone (1010), in which the sensor membrane can be contacted for a controlled fluid removal via a single absorbent component (1018). The flow channel components may be made of materials previously discussed in the above embodiments. The absorbent component (1018) is an integral part of the front portion of the enclosure (1012). Its position within the cartridge assembly is such that when the front (1012) and rear (1013) portions of the enclosure are assembled with the fluidic device, the absorbent component (1018) touches the contact zone (1010) of each sensor membrane. In certain embodiments, the absorbent component may be about 5 mm to about 25 mm in length, about 5 mm to about 35 mm in width and about 0.3 mm to about 2 mm in thickness. In certain embodiments, the contact area between the absorbent component (1018) and the contact zone (1010) of each sensor membrane may be about 1 mm to about 10 mm in length, and have substantially the same width as the sensor membrane. The absorbent component may be comprised of materials previously discussed in the above embodiments.

Figure 11A:
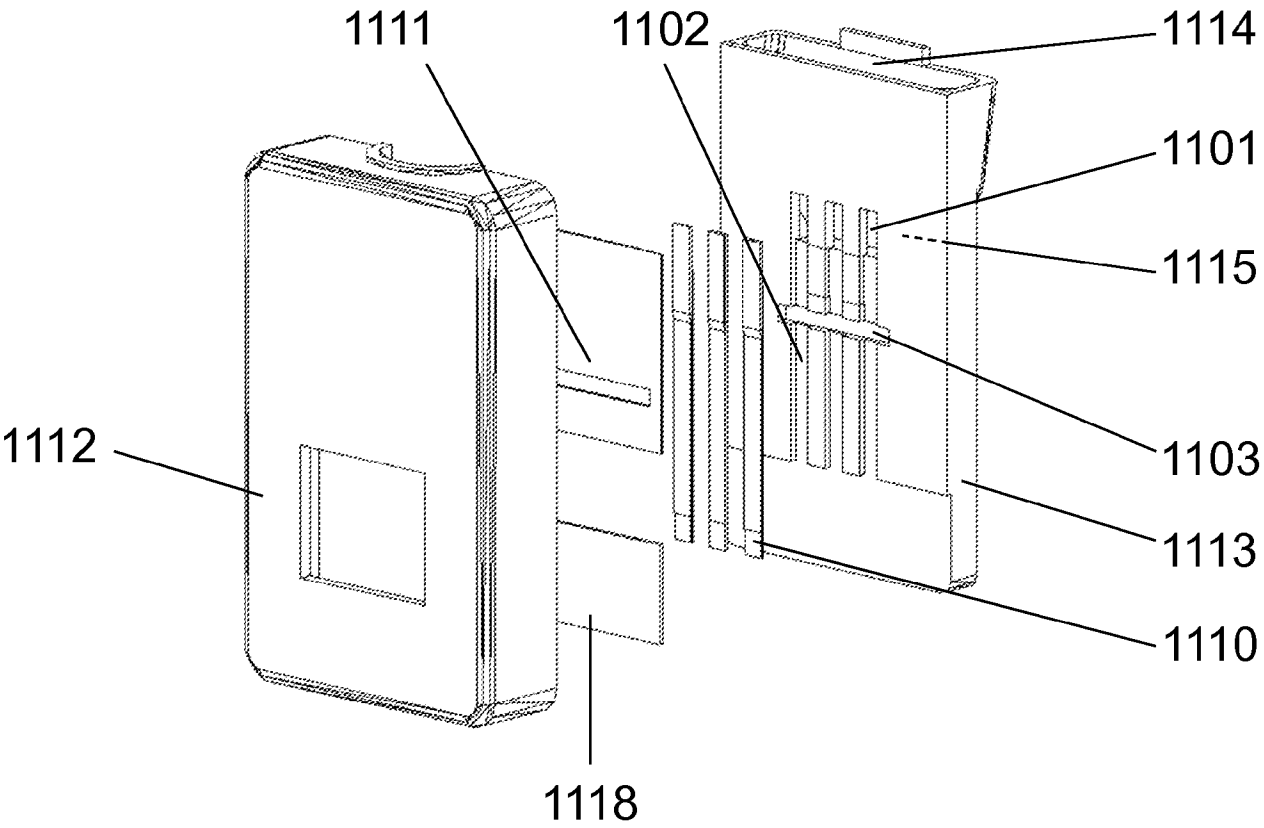
FIGS. 11*a*-11*b* show different views of an exemplary fluidic device and cartridge assembly.
Figure 11B:
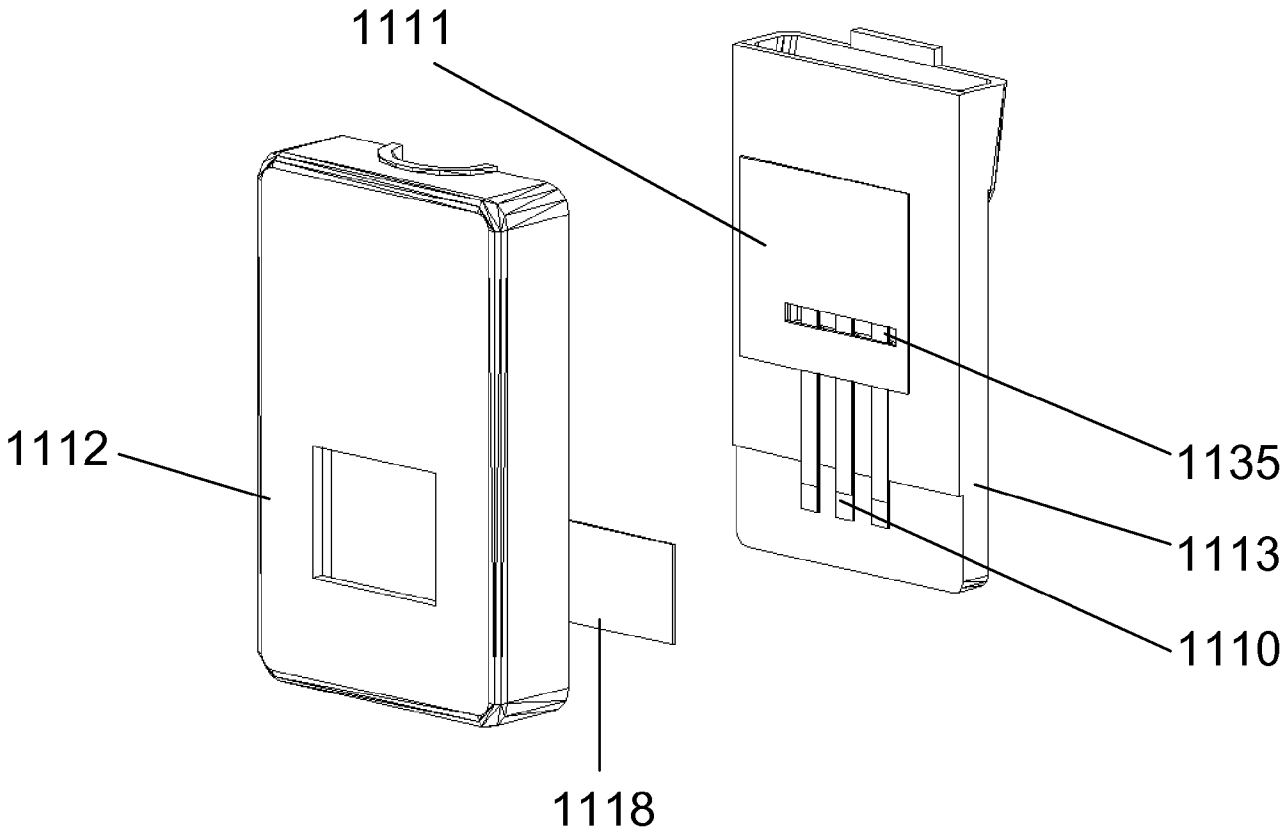

FIGS. 11*a*-11*b* show an alternative cartridge assembly where the fluidic device (1113) makes up the rear portion of the assembly (instead of having a fluidic device sandwiched between front and rear portions of an enclosure). As shown in FIG. 11*a*, the fluidic device (1113) is comprised of a substrate that includes a sample reservoir (1115) with an inlet (1114) for receiving a fluid sample. The front portion of the cartridge assembly (1112) has an inspection window that allows the capture zone of the sensor membrane to be inspected. In certain embodiments, the sample reservoir (1115) is about 10 mm to about 20 mm in length, about 20 mm to about 35 mm in width and about 1 mm to about 3 mm in depth. The fluidic device (1113) comprises three flow channels (1101) within an upper surface of the substrate that can be used to simultaneously run multiple independent assays. It is to be understood that any number of flow channels could be included in a fluidic device (e.g., 1, 2, 3, 4, 5, 6, 7, 8 or more). Each flow channel (1101) comprises a reagent pad, a sensor membrane and a top support covering a least a portion of the sensor membrane. A cover (1111) is also included to seal the reagent pad and part of the sensor membrane within the flow channel (1101). A flow control zone (1103) extending around the sensor membrane includes a flow control medium for guiding fluid samples to and through the sensor membrane. Each sensor membrane comprises a contact zone (1110) where the sensor membrane can be contacted with an absorbent component (1118) for a controlled fluid removal. These flow channel and cartridge components may be made from the materials discussed above in the context of other embodiments.

In certain embodiments, each flow channel has a length of about 25 mm to about 75 mm, a width of about 1.3 mm to about 5 mm, and a height of about 0.3 mm to about 1.0 mm. Each flow channel (1101) comprises an inlet (1102) upstream from the reagent pad and sensor membrane. The inlet (1102) is in fluidic communication with the sample reservoir (1115). In certain embodiments, the inlet (1102) has a length of about 1 mm to about 5 mm and a width of about 1.3 mm to about 5 mm. In certain embodiments the inlet (1102) has substantially the same width as the flow channel. There is also an exit at the downstream end of each flow channel. This exit is defined as a downstream channel section which is not covered by the cover (1111). In certain embodiments, the exit opening is about 3 mm to about 10 mm in length and about 5 mm to about 35 mm in width As shown in FIG. 11*a*, the cartridge assembly also comprises a flow control zone (1103) extending around each sensor membrane. The flow control zone (1103) is filled with a flow control medium which provides each of the sensor membranes with a water tight enclosure within their respective flow channels. The flow control zone may comprise one continuous chamber which intersects all of the flow channels (1101). In certain embodiments, the flow control zone (1103) has a length of about 0.5 mm to about 3 mm, a width of about 2 mm to about 35 mm, and a depth that is substantially the same as the depth of the flow channel (1101). In certain embodiments, the flow control zone is aligned about 1 mm to about 5 mm downstream of the free space diffusion zone. As shown in FIG. 11*b*, the cartridge assembly also includes an opening (1135) in the cover layer (1111) which enables the insertion of the flow control medium into the flow control zone (1103). In certain embodiments, a plurality of openings may be used instead of a single continuous opening as shown in FIG. 11*b*. In certain embodiments, the opening(s) have a length of about 0.5 mm to about 3 mm (in the direction of the flow channel) and a width of about 2 mm to about 35 mm (across the flow channel).

The absorbent component (1118) is an integral part of the front portion of the cartridge assembly (1112) and is positioned such that, when the front (1112) and rear (1113) portions of the cartridge assembly are assembled, the absorbent component (1118) contacts the contact zone (1110) of the sensor membranes. In certain embodiments the absorbent component (1118) may be about 5 mm to about 25 mm in length, about 5 mm to about 35 mm in width, and about 0.3 mm to about 2 mm in thickness. In certain embodiments, the contact area between the absorbent component (1118) and the contact zone (1110) of the sensor membrane may be about 1 mm to about 10 mm in length and have substantially the same width as the sensor membrane. The absorbent component may be made of materials that were previously discussed in the above embodiments.

In some embodiments, the absorbent component (1118) is made of cellulose material, cotton fiber or open cell polyurethane foam and is about 10 mm in length, about 35 mm in width and about 1.5 mm in thickness. In some such embodiments, the contact area between the absorbent component (1118) and each of the contact zones (1110) is about 3 mm to about 5 mm in length and substantially as wide as the sensor membrane.

In some embodiments, the flow channel has a length of about 40 mm, a width of about 2.5 mm or about 4 mm, and a depth of about 0.6 mm. The inlet has a length of about 5 mm, a width of about 2.5 mm or about 4 mm (or substantially the same width as the flow channel). The flow channel comprises an exit at the downstream end of each flow channel. This exit is defined by an opening in the lower surface of the substrate which corresponds with the position of the flow channels. The size of the exit is about 7 mm in length and about 2.5 mm or about 4 mm in width. The flow control zone has a length of about 2 mm, a width of about 35 mm, and a depth that is substantially the same as the depth of the flow channel. In certain embodiments, the flow control zone is aligned about 5 mm downstream of the free space diffusion zone. The fluidic device further comprises openings in the cover (1111), which correspond with the position of the flow control zones in each of the flow channels, and which have a length of about 2 mm (in the direction of the flow channel) and a width of about 35 mm (across the flow channel).

EXAMPLES

The following examples serve to further illustrate the methods and devices of the present disclosure. These examples are in no way intended to limit the scope of the invention.

Example 1

A Triplex Cardiac Marker Sandwich Assay Panel Comprising C-Reactive Protein (CRP), Myoglobin and Troponin I This example describes a triplex assay panel for detecting the presence of the following cardiac proteins: c-reactive protein (CRP), myoglobin and troponin I. The assay was a sandwich immunoassay which used a mobilizable labeled anti-analyte antibody in the reagent pad to form a complex with target analyte in the fluid sample and an immobilized anti-analyte antibody to capture the complex in the capture zone of the sensor membrane.

Monoclonal anti-human myoglobin (Medix Biomedica), monoclonal mouse anti-human CRP (Hytest), monoclonal mouse anti troponin I IgG (Fitzgerald) and monoclonal mouse anti troponin I (Fitzgerald) antibodies were used for the labeled antibody reagents of the reagent pad and the unlabeled antibody reagents of the sensor membrane. For troponin I we used two complementary assay components in order to increase sensitivity. Each pair is directed towards different portions of the troponin I molecule.

Fluorescent dye Dylight 649 (Thermo Scientific) was coupled to the monoclonal antibodies to make the labeled antibody reagents of the reagent pad as follows. Antibodies were first clarified by centrifugation and then re-suspended in borate buffer (50 mM) at an antibody concentration of 1 mg/ml. An aliquot of Dylight 649 at a concentration of 10 mg/ml was added to the re-suspended antibody solution and allowed to react for one hour. The reacted solution was dialysed against phosphate buffer saline, with two changes of buffer, over a 4 hour duration. The labeled antibody reagents were striped onto reagent pads made of glass fiber (Ahlstrom) using in-line striping equipment (Imagene) such that each individual flow channel was configured for the detection of a single analyte. A labeled control reagent (rabbit anti-sheep antibody from Dako coupled to Dylight 649) was also striped onto each reagent pad.

Unlabeled antibody reagents were immobilized on the sensor membrane at a concentration of 1 mg/ml in their respective capture zones using in-line striping equipment (Imagene). The control capture reagent, a goat anti-rabbit IgG, was striped onto each respective sensor membrane in the control zone (downstream of each capture zone) at a concentration of 0.5 mg/ml. The sensor membranes were then dried.

The reagent pad and sensor membrane for each target analyte were placed and fixed on a solid water impermeable bottom support (G&L Precision Die Cutting) using an adhesive with a free space diffusion zone separating the reagent pad and sensor membrane. An optically clear overlaminate (G&L Precision Die Cutting) was placed over the reagent pad and a portion of the sensor membrane pad, covering the free space diffusion zone. The overlaminate was positioned so as to leave a 3 mm contact zone of exposed nitrocellulose at the distal end of the sensor membrane.

The three separate assemblies (one per target analyte) were then placed into the individual channels of a three channel fluidic device. The channels were 2.5 mm wide (same width as the assemblies) and incorporated flow control zones as illustrated in FIG. 5*d*. A UV curable adhesive of a viscosity of 12,000 cP (Dymax) was used as the flow control medium. The UV curable adhesive was dispensed in liquid form into the upper and lower portions of the flow control zone (503 in FIG. 5*d*). The dispensed UV curable adhesive was cured at an intensity of 20 W/cm$^2$ at a wavelength of about 365 nm for 20 seconds for both the upper and lower sides of the fluidic device using LED based UV curing equipment (Epilight). The fluidic device was assembled into a cartridge assembly which included a bulk absorbent material made of cellulose (Alstrom). Assembly of the cartridge assembly brought the bulk absorbent material into contact with the exposed contact zones of the sensor membranes.

Each assay was performed by introducing a delipidised serum sample via the sample inlet of a vertically oriented cartridge. The serum sample contained known concentrations of all three cardiac marker analytes (300 ng/mL troponin I, 800 ng/mL myoglobin and 0.3 μg/mL CRP) and was diluted 1:1 in a sample buffer. The serum sample flowed down into the sample reservoir of the cartridge assembly and on into the inlets of the flow channels. From there the serum sample progressed into and through the reagent pad, across the free diffusion zone, into the sensor membrane and finally into the bulk absorbent material. Each assay was performed in 15 minutes. Optical emission along the longitudinal direction of the sensor membranes, including fluorescent signals from the capture and control zones, were detected and reported by a bench top fluorescence reader instrument. The generation of signals in the control zone confirmed that the serum sample flowed through and past the sensor membrane capture zones.

Results from one such assay are shown in FIG. 1. The traces correspond to the fluorescent signals measured along the longitudinal axis of sensor membranes detecting troponin I (dashed line), myoglobin (solid line) or c-reactive protein (CRP) (dotted line). The peaks around the 3.5 mm position originate from the control capture zone of the sensor membrane. These correspond to labeled control reagents that were mobilized from the reagent pad by the serum sample and then captured by the immobilized control capture reagents. The peaks around the 11 mm position originate from the test capture zone of the sensor membrane. These correspond to labeled reagent-cardiac marker analyte complexes that have been captured by immobilized capture antibodies. The magnitudes of these peaks are directly related to the concentration of analyte in the original serum sample.

Figure 12:
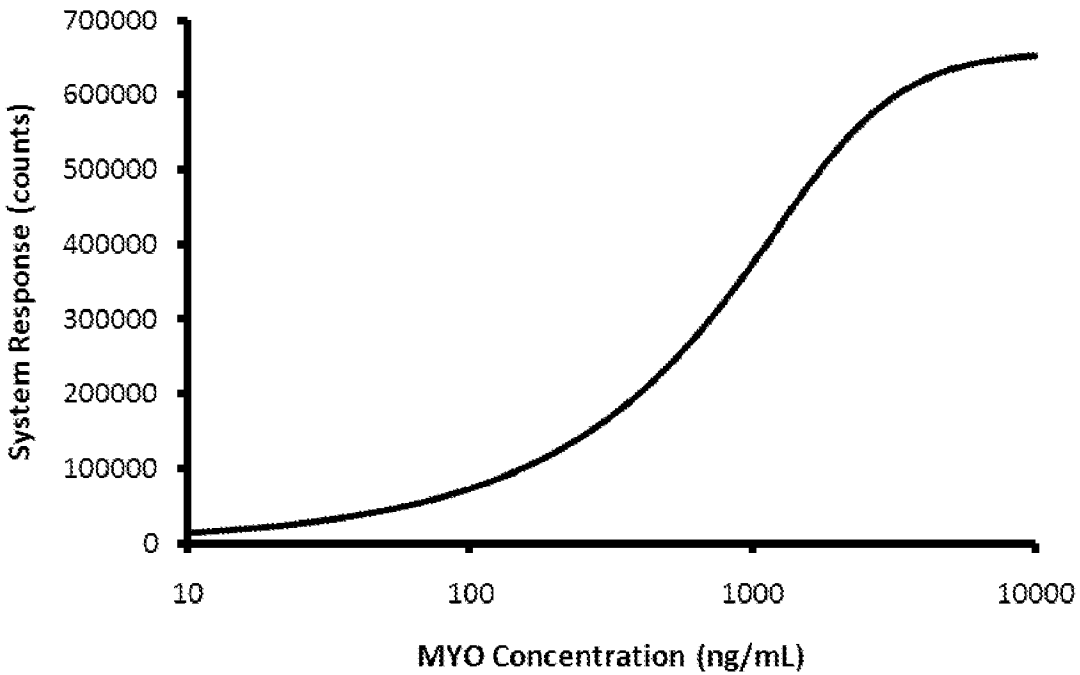
FIG. 12 shows the standard fluorescence response curve for myoglobin from an exemplary quantitative multi-analyte immuno chromatographic sandwich assay for cardiac markers.

A standard response curve was generated for each assay. This curve characterises the response of the assay to a range of concentrations of the associated cardiac marker analyte (troponin I, myoglobin or c-reactive protein) in delipidized serum. Each assay curve was produced by assaying multiple replicate samples at specific analyte concentrations and fitting a mathematical function to the response. An exemplary standard response curve for myoglobin that was obtained using a 5-parameter log-logistic fit is shown in FIG. 12. With reference to these curves, quantitative measurements of analyte concentrations may then be estimated on a serum sample with unknown amounts of each target analyte.

Example 2

A Duplex Drugs of Abuse Competitive Assay Panel Comprising Cocaine (COC) and Methamphetamine (MET)

This example describes a duplex assay panel for detecting the presence of the following drugs of abuse: cocaine (COC) and methamphetamine (MET). The assay was a competitive immunoassay which used mobilizable labeled anti-analyte antibodies in the reagent pad and an immobilized analyte analog to capture the labeled anti-analyte antibodies in the detection zone of the sensor membrane. The control set up was as described above for the assay of Example 1.

Monoclonal mouse anti-benzoylecgonine (Fitzgerald) and monoclonal anti-methamphetamine (Arista Biologicals Inc.) were used for the labeled antibody reagents of the reagent pad. Fluorescent dye Dylight 649 (Thermo Scientific) was coupled to the monoclonal antibodies to make the labeled antibody reagents of the reagent pad as follows. Antibodies were first clarified by centrifugation and re-suspended in borate buffer (50 mM) at an antibody concentration of 1 mg/ml. An aliquot of Dylight 649 at a concentration of 10 mg/ml was added to the re-suspended antibody solution and allowed to react for one hour. The reacted solution was dialysed against phosphate buffer saline, with two changes of buffer, over a 4 hour duration.

The labeled antibody reagents were striped onto reagent pads made of glass fiber (Ahlstrom) using in-line striping equipment (Imagene) such that each individual flow channel was configured for the detection of a single analyte.

The unlabeled capture reagents: benzoylecgonine-BSA antigen conjugate (East Coast Bio) and methamphetamine-BSA antigen conjugate (Arista Biologicals Inc) were immobilized on the sensor membrane at a concentration of 0.25 mg/ml in their respective capture zones using in-line striping equipment (Imagene). The sensor membranes were then dried. The components of the assay were then assembled in the same manner as the assay of Example 1.

Each assay was performed by introducing a saliva sample via the sample inlet of a vertically oriented cartridge. The saliva sample contained known concentrations of both cocaine and methamphetamine (100 ng/mL each) and was diluted 1:1 in a sample buffer. The saliva sample flowed down into the sample reservoir of the cartridge assembly and on into the inlets of the flow channels. From there the serum sample progressed into and through the reagent pads, across the free diffusion zone, into the sensor membrane and finally into the bulk absorbent material. Each assay was performed in 10 minutes. Optical emission along the longitudinal direction of the sensor membranes, including fluorescent signals from the capture and control zones, were detected and reported by a bench top fluorescence reader instrument. The generation of signals in the control zone confirmed that the saliva sample flowed through and past the sensor membrane capture zones.

Figure 2:
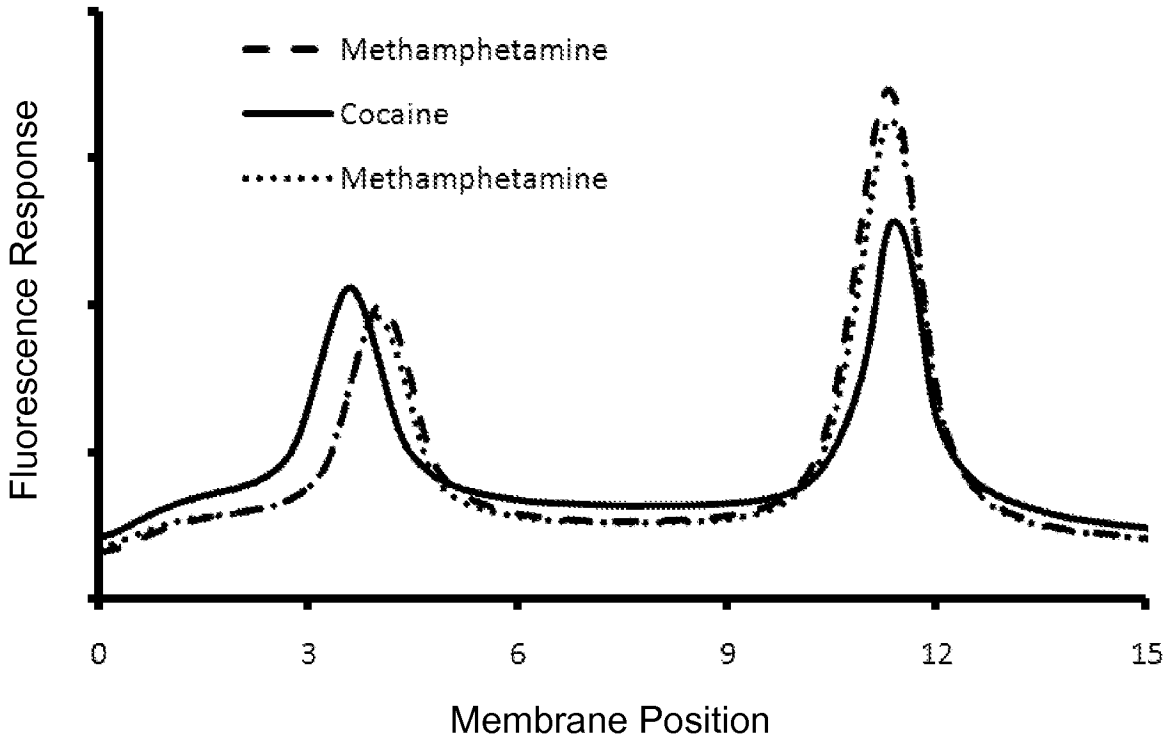
FIG. 2 shows the fluorescence response from an exemplary quantitative multi-analyte immuno-chromatographic competitive assay for drugs of abuse.

Results from one such assay are shown in FIG. 2. The traces correspond to the fluorescent signals measured along the longitudinal axis of sensor membranes detecting methamphetamine (dashed and dotted lines) and cocaine (sold line). The peaks around the 3.5 mm position originate from the control capture zone of the sensor membrane. These correspond to labeled control reagents that were mobilized from the reagent pad by the saliva sample and then captured by the immobilized control capture reagents. The peaks around the 11 mm position originate from the test capture zone of the sensor membrane. These correspond to labeled reagents that have been captured by immobilized capture antibodies. The magnitudes of these peaks are inversely related to the concentration of analyte in the original saliva sample (the analyte competes with the labeled reagents for binding to the immobilized capture antibodies and thereby reduces the signal when present). We have used this assay to provide a semi-quantitative positive result for both analytes with a threshold detection concentration of 35 ng/mL for methamphetamine and 30 ng/mL for cocaine.

Example 3

A Triplex Cardiac Marker Sandwich Assay Panel Comprising C-Reactive Protein (CRP), Myoglobin and Troponin I, Using an Alternative UV Curing Dispensing and Curing Method All other example conditions were identical to those give in example 1.

The three separate assemblies (one per target analyte) were placed into the individual channels of a three channel fluidic device. The channels were 2.5 mm wide (same width as the assemblies) and incorporated flow control zones as illustrated in FIG. 10*a*. A UV curable adhesive of a viscosity of 14,000 cP (Dymax) was used as the flow control medium. The UV curable adhesive was dispensed into the flow control zone (1003 in FIG. 10*a*) in liquid form using a digital syringe dispenser (Loctite) set to 10 psi. The dispensed UV curable adhesive was cured for 30 seconds using a Loctite LED Controller and CureJet 405 (Loctite). The fluidic device was assembled into a cartridge assembly which included a bulk absorbent material made of cellulose (Alstrom). Assembly of the cartridge assembly brought the bulk absorbent material into contact with the exposed contact zones of the sensor membranes.

Other embodiments of the invention will be apparent to those skilled in the art from a consideration of the specification or practice of the invention disclosed herein. It is intended that the specification and Examples be considered as exemplary only, with the true scope of the invention being indicated by the following claims.

We claim:

1. A fluidic device for flow control in an assay comprising:
- a water impermeable substrate with a flow channel located on its upper surface;
- a porous reagent pad located within the flow channel, where the reagent pad includes a release zone that comprises a mobilizable reagent component of an assay;
- a porous sensor membrane located within the flow channel downstream from the reagent pad, where the sensor membrane is separated from the reagent pad by a free space diffusion zone and where the sensor membrane includes a capture zone that comprises an immobilized capture component of the assay;
- a water impermeable top support located within the flow channel and disposed over at least a portion of the sensor membrane; and
- a flow control medium that forms a water impermeable seal around a portion of the top support and sensor membrane, where the seal is configured to direct flow of fluid into the sealed portion of the sensor membrane.

2. The fluidic device of claim 1, where the mobilizable reagent component of the assay is labeled and the immobilized capture component is unlabeled.

3. The fluidic device of claim 1, where the immobilized capture component binds to the mobilizable reagent component of the assay.

4. The fluidic device of claim 1, where the mobilizable reagent component of the assay binds to a target analyte in a fluid sample to form a complex and the immobilized capture component binds to the complex.

5. The fluidic device of claim 1, where the mobilizable reagent component of the assay binds to a target analyte in a fluid sample to form a complex and the immobilized capture component binds to the mobilizable reagent component but not to the complex.

6. The fluidic device of claim 1, where the water impermeable top support is disposed over at least a portion of the reagent pad, the free space diffusion zone and at least a portion of the sensor membrane.

7. The fluidic device of claim 1 further comprising:

a water impermeable bottom support located within the flow channel and disposed under at least a portion of the reagent pad and at least a portion of the sensor membrane.

8. The fluidic device of claim 7, where the flow control medium forms a water impermeable seal that surrounds a portion of the top support, sensor membrane and bottom support.

9. The fluidic device of claim 1, where the flow control medium forms a water impermeable seal around a portion of the sensor membrane that interfaces with the free space diffusion zone.

10. The fluidic device of claim 1, where the flow control medium forms a water impermeable seal around a portion of the sensor membrane located downstream from the interface between the sensor membrane and the free space diffusion zone.

11. The fluidic device of claim 1, where the flow control medium forms a water impermeable seal around a portion of the sensor membrane located upstream from the capture zone.

12. The fluidic device of claim 1, where the free space diffusion zone receives fluid from the reagent pad, and acts as a reaction well for the binding of analytes and mobilized assay reagents.

13. The fluidic device of claim 12, in which the free space diffusion zone volume is sufficient to ensure initial rapid, unidirectional fluid flow through the reagent pad.

14. The fluidic device of claim 12, in which the free space diffusion zone volume regulates or homogenises the concentration of mobilized reagent in the fluid sample.

15. The fluidic device of claim 12, in which a portion of the sensor membrane is disposed upstream of the top support, within the free space diffusion zone.

16. A cartridge assembly comprising;

a fluidic device as defined in claim 1 sandwiched between front and rear portions of an enclosure, where the front portion of the enclosure includes an inspection window that allows the capture zone of the sensor membrane of the fluidic device to be inspected, a sample reservoir is located between the fluidic device and the rear portion of the enclosure, and the sample reservoir is in fluidic communication with the flow channel of the fluidic device via an inlet on a lower surface of the substrate of the fluidic device.

17. A cartridge assembly comprising;

front and rear portions, where the rear portion is comprised of a fluidic device as defined in claim 1 and where the front portion includes an inspection window that allows the capture zone of sensor membrane of the fluidic device to be inspected, a sample reservoir is located within the substrate of the fluidic device, and the sample reservoir is in fluidic communication with the flow channel of the fluidic device.

18. A method of making a fluidic device for flow control in an assay comprising steps of:

providing a water impermeable substrate with a flow channel located on its upper surface;

placing a porous reagent pad within the flow channel, where the reagent pad includes a release zone that comprises a mobilizable reagent component of an assay;

placing a porous sensor membrane within the flow channel downstream from the reagent pad, where the sensor membrane is separated from the reagent pad by a free space diffusion zone and where the sensor membrane includes a capture zone that comprises an immobilized capture component of the assay;

placing a water impermeable top support within the flow channel and over at least a portion of the sensor membrane; and introducing a flow control medium that forms a water impermeable seal around a portion of the top support and sensor membrane, where the seal is configured to direct flow of fluid from the free space diffusion zone into the sealed portion of the sensor membrane.

19. A method of making a cartridge assembly comprising steps of:

providing a fluidic device as defined in claim 1; and sandwiching the fluidic device between front and rear portions of an enclosure, where the front portion of the enclosure includes an inspection window that allows the capture zone of the sensor membrane of the fluidic device to be inspected, a sample reservoir is located between the fluidic device and the rear portion of the enclosure, and the sample reservoir is in fluidic communication with the flow channel of the fluidic device via an inlet on a lower surface of the substrate of the fluidic device.

20. A method of making a cartridge assembly comprising steps of:

providing a rear portion of the cartridge assembly that is comprised of a fluidic device as defined in claim 1; and contacting it with a front portion of the cartridge assembly, where the front portion includes an inspection window that allows the capture zone of the sensor membrane of the fluidic device to be inspected, a sample reservoir is located within the substrate of the fluidic device, and the sample reservoir is in fluidic communication with the flow channel of the fluidic device.

* * * * *